US011641551B2

(12) United States Patent
Qi et al.

(10) Patent No.: US 11,641,551 B2
(45) **Date of Patent: *May 2, 2023**

(54) BONE CONDUCTION SPEAKER AND COMPOUND VIBRATION DEVICE THEREOF

(71) Applicant: SHENZHEN SHOKZ CO., LTD., Guangdong (CN)

(72) Inventors: Xin Qi, Shenzhen (CN); Fengyun Liao, Shenzhen (CN); Jinbo Zheng, Shenzhen (CN); Qian Chen, Shenzhen (CN); Hao Chen, Shenzhen (CN); Lei Zhang, Shenzhen (CN); Junjiang Fu, Shenzhen (CN); Bingyan Yan, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 55 days.

This patent is subject to a terminal disclaimer.

(21) Appl. No.: 17/218,645

(22) Filed: Mar. 31, 2021

(65) Prior Publication Data

US 2021/0250696 A1 Aug. 12, 2021

Related U.S. Application Data

(63) Continuation-in-part of application No. 17/170,920, filed on Feb. 9, 2021, now Pat. No. 11,122,359, and (Continued)

(30) Foreign Application Priority Data

Dec. 23, 2011 (CN) ..... 201110438083.9
Apr. 30, 2019 (CN) ..... 201910364346.2

(Continued)

(51) Int. Cl.
*H04R 9/06* (2006.01)
*H04R 1/00* (2006.01)

(Continued)

(52) U.S. Cl.
CPC ..... *H04R 9/063* (2013.01); *H04R 1/00* (2013.01); *H04R 1/10* (2013.01); *H04R 9/02* (2013.01);

(Continued)

(58) Field of Classification Search
CPC ..... H04R 1/1075; H04R 9/02; H04R 9/06; H04R 9/025; H04R 9/066; H04R 11/02;

(Continued)

(56) References Cited

U.S. PATENT DOCUMENTS 2,075,196 A 3/1937 Hand
4,418,248 A 11/1983 Mathis (Continued)

FOREIGN PATENT DOCUMENTS

CN 1842019 A 10/2006
CN 1976541 A 6/2007

(Continued)

OTHER PUBLICATIONS

M. Gripper et al., Using the Callsign Acquisition Test (CAT) to Compare the Speech Intelligibility of Air Versus Bone Conduction, International Journal of Industrial Ergonomics, 37(7): 631-641, 2007.

(Continued)

*Primary Examiner* — Norman Yu
(74) *Attorney, Agent, or Firm* — Metis IP LLC

(57) ABSTRACT

The present invention relates to a bone conduction speaker and its compound vibration device. The compound vibration device comprises a vibration conductive plate and a vibration board, the vibration conductive plate is set to be the first (Continued)

torus, where at least two first rods inside it converge to its center; the vibration board is set as the second torus, where at least two second rods inside it converge to its center. The vibration conductive plate is fixed with the vibration board; the first torus is fixed on a magnetic system, and the second torus comprises a fixed voice coil, which is driven by the magnetic system. The bone conduction speaker in the present invention and its compound vibration device adopt the fixed vibration conductive plate and vibration board, making the technique simpler with a lower cost; because the two adjustable parts in the compound vibration device can adjust both low frequency and high frequency area, the frequency response obtained is flatter and the sound is broader.

20 Claims, 19 Drawing Sheets

Related U.S. Application Data a continuation-in-part of application No. 17/170,817, filed on Feb. 8, 2021, now Pat. No. 11,395,072, which is a continuation of application No. 17/161,717, filed on Jan. 29, 2021, now Pat. No. 11,399,234, said application No. 17/170,920 is a continuation of application No. PCT/CN2020/087002, filed on Apr. 26, 2020, said application No. 17/161,717 is a continuation-in-part of application No. 16/833,839, filed on Mar. 30, 2020, and a continuation-in-part of application No. 16/159,070, filed on Oct. 12, 2018, now Pat. No. 10,911,876, said application No. 16/833,839 is a continuation of application No. 15/752,452, filed on Feb. 13, 2018, now Pat. No. 10,609,496, which is a continuation of application No. 15/197,050, filed as application No. PCT/CN2015/086907 on Aug. 13, 2015, now Pat. No. 10,117,026, and a continuation of application No. 14/513,371, filed on Oct. 14, 2014, now Pat. No. 9,402,116, which is a continuation of application No. 13/719,754, filed on Dec. 19, 2012, now Pat. No. 8,891,792.

(30) Foreign Application Priority Data

Sep. 19, 2019 (CN) ..... 201910888067.6
Sep. 19, 2019 (CN) ..... 201910888762.2

(51) Int. Cl.
*H04R 9/02* (2006.01)
*H04R 31/00* (2006.01)
*H04R 1/10* (2006.01)
*H04R 25/00* (2006.01)

(52) U.S. Cl.
CPC ..... *H04R 9/025* (2013.01); *H04R 9/066* (2013.01); *H04R 31/00* (2013.01); *H04R 25/606* (2013.01); *H04R 2460/13* (2013.01)

(58) Field of Classification Search
CPC ..... H04R 31/00; H04R 25/606; H04R 2225/021; H04R 2225/023; H04R 2225/67; H04R 2400/03; H04R 2420/07; H04R 2460/13; H04R 2499/11; H04R 25/48
USPC ..... 381/151, 380, 162, 182, 326
See application file for complete search history.

(56) References Cited

U.S. PATENT DOCUMENTS

| | | | | |
|---|---|---|---|---|
| 5,127,060 | A | 6/1992 | Paddock | |
| 5,327,506 | A | 7/1994 | Stites, III | |
| 5,673,328 | A | 9/1997 | Wandl et al. | |
| 5,734,132 | A | 3/1998 | Proni | |
| 5,790,684 | A | 8/1998 | Niino et al. | |
| 6,062,337 | A | 5/2000 | Zinserling | |
| 6,389,148 | B1 | 5/2002 | Yoo et al. | |
| 6,738,485 | B1 | 5/2004 | Boesen | |
| 6,850,138 | B1 | 2/2005 | Sakai | |
| 8,691,792 | B2 | 4/2014 | Xu et al. | |
| 9,226,075 | B2 | 12/2015 | Lee | |
| 9,253,563 | B2 | 2/2016 | Fukuda | |
| 9,742,887 | B2 | 8/2017 | Hosoi et al. | |
| 10,555,106 | B1 | 2/2020 | Mehra | |
| 10,609,465 | B1 | 3/2020 | Wakeland et al. | |
| 11,122,359 | B2 | 9/2021 | Zhang et al. | |
| 2003/0012395 | A1* | 1/2003 | Fukuda | H04R 9/066 381/151 |
| 2003/0053651 | A1 | 3/2003 | Koura et al. | |
| 2004/0105566 | A1 | 6/2004 | Matsunaga et al. | |
| 2004/0131218 | A1 | 7/2004 | Dedieu et al. | |
| 2006/0098829 | A1 | 5/2006 | Kobayashi | |
| 2006/0165246 | A1 | 7/2006 | Lee et al. | |
| 2006/0262954 | A1 | 11/2006 | Lee et al. | |
| 2007/0053536 | A1 | 3/2007 | Westerkull | |
| 2007/0098198 | A1 | 5/2007 | Hildebrandt | |
| 2008/0166007 | A1 | 7/2008 | Hankey et al. | |
| 2009/0097681 | A1 | 4/2009 | Puria et al. | |
| 2009/0147981 | A1 | 6/2009 | Blanchard et al. | |
| 2009/0209806 | A1 | 8/2009 | Hakansson | |
| 2009/0245553 | A1 | 10/2009 | Parker | |
| 2009/0285417 | A1 | 11/2009 | Shin et al. | |
| 2010/0046783 | A1 | 2/2010 | Huang | |
| 2010/0310106 | A1 | 12/2010 | Blanchard et al. | |
| 2010/0329485 | A1 | 12/2010 | Fukuda | |
| 2011/0022119 | A1* | 1/2011 | Parker | H04R 25/00 607/56 |
| 2011/0170730 | A1 | 7/2011 | Zhu | |
| 2012/0020501 | A1 | 1/2012 | Lee | |
| 2012/0083860 | A1 | 4/2012 | Hakansson | |
| 2012/0281861 | A1 | 11/2012 | Lin | |
| 2012/0286765 | A1* | 11/2012 | Heuvel | H04R 25/606 600/25 |
| 2012/0300956 | A1 | 11/2012 | Horii | |
| 2012/0302822 | A1 | 11/2012 | Van Himbeeck et al. | |
| 2013/0051585 | A1 | 2/2013 | Karkkainen et al. | |
| 2013/0108068 | A1 | 5/2013 | Poulsen et al. | |
| 2013/0121513 | A1 | 5/2013 | Adachi | |
| 2013/0156241 | A1 | 6/2013 | Jinton | |
| 2013/0163791 | A1 | 6/2013 | Qi et al. | |
| 2013/0308798 | A1 | 11/2013 | Lee | |
| 2014/0064533 | A1 | 3/2014 | Kasic, II | |
| 2014/0270293 | A1 | 9/2014 | Ruppersberg et al. | |
| 2015/0130945 | A1 | 5/2015 | Yu et al. | |
| 2015/0208183 | A1 | 7/2015 | Bern | |
| 2015/0264473 | A1 | 9/2015 | Fukuda | |
| 2016/0037243 | A1 | 2/2016 | Lippert et al. | |
| 2016/0127841 | A1 | 5/2016 | Horii | |
| 2017/0230741 | A1 | 8/2017 | Matsuo et al. | |
| 2017/0374479 | A1 | 12/2017 | Qi et al. | |
| 2018/0376231 | A1 | 12/2018 | Pfaffinger | |
| 2019/0014425 | A1 | 1/2019 | Liao et al. | |
| 2019/0052954 | A1 | 2/2019 | Rusconi Clerici Beltrami et al. | |
| 2019/0238971 | A1 | 8/2019 | Wakeland et al. | |
| 2020/0137476 | A1 | 4/2020 | Shinmen et al. | |
| 2020/0169801 | A1 | 8/2020 | Zhu | |
| 2020/0252708 | A1 | 8/2020 | Zhu | |

FOREIGN PATENT DOCUMENTS

| | | | |
|---|---|---|---|
| CN | 202435598 | U | 9/2012 |
| CN | 105007551 | A | 10/2015 |
| CN | 105101019 | A | 11/2015 |
| CN | 105101020 | A | 11/2015 |

(56) References Cited

FOREIGN PATENT DOCUMENTS

| | | | |
|---|---|---|---|
| CN | 105142077 | A | 12/2015 |
| CN | 204887455 | U | 12/2015 |
| CN | 205142506 | U | 4/2016 |
| CN | 106792304 | A | 5/2017 |
| CN | 109640209 | A | 4/2019 |
| EP | 1404146 | A1 | 3/2004 |
| EP | 2234413 | B1 | 11/2020 |
| JP | S5574290 | A | 6/1980 |
| JP | 07007797 | A | 1/1995 |
| JP | 2003264882 | A | 9/2003 |
| JP | 2004064457 | A | 2/2004 |
| JP | 2004158961 | A | 6/2004 |
| JP | 2005151183 | A | 6/2005 |
| JP | 2006025333 | A | 1/2006 |
| JP | 2007129384 | A | 5/2007 |
| JP | 2008017398 | A | 1/2008 |
| JP | 2008054063 | A | 3/2008 |
| JP | 2011160175 | A | 8/2011 |
| JP | 2013243564 | A | 12/2013 |
| KR | 20010111653 | A | 12/2001 |
| KR | 20050030183 | A | 3/2005 |
| KR | 20070122104 | A | 12/2007 |
| KR | 20080101166 | A | 11/2008 |
| KR | 20090082999 | A | 8/2009 |
| KR | 20090091378 | A | 8/2009 |
| KR | 20110037483 | A | 4/2011 |
| KR | 200476572 | Y1 | 3/2015 |
| KR | 20170133754 | A | 12/2017 |
| WO | 0219759 | A1 | 3/2002 |
| WO | 2006088410 | A1 | 8/2006 |
| WO | 2010114195 | A1 | 10/2010 |
| WO | 2015087093 | A | 6/2015 |

OTHER PUBLICATIONS

Martin L. Lenhardt et al., Measurement of Bone Conduction Levels for High Frequencies, International Tinnitus Journal, 8(1): 9-12, 2002.
The Extended European Search Report in European Application No. 21186537.3 dated Nov. 9, 2021, 9 pages.
Notice of Preliminary Rejection in Korean Application No. 10-2022-7003237 dated Apr. 13, 2022, 14 pages.
Notice of Reasons for Rejection in Japanese Application No. 2020-088413 dated Aug. 3, 2021, 8 pages.
First Office Action in Chinese Application No. 201110438083.9 dated Sep. 27, 2012, 10 pages.
The Extended European Search Report in European Application No. 12860348.7 dated Apr. 28, 2015, 7 pages.
International Search Report in PCT/CN2012/086513 dated Mar. 14, 2013, 5 pages.
Written Opinion in PCT/CN2012/086513 dated Mar. 14, 2013, 10 pages.
International Search Report in PCT/CN2015/086907 dated May 6, 2016, 10 pages.
Written Opinion in PCT/CN2015/086907 dated May 6, 2016, 12 pages.
Communication Pursuant to Article 94(3) EPC in European Application No. 15900793.9 dated Apr. 10, 2019, 6 pages.
Communication Pursuant to Article 94(3) EPC in European Application No. 15900793.9 dated Apr. 28, 2020, 9 pages.
Notice of Reasons for Rejection in Japanese Application No. 2018-506985 dated Sep. 3, 2019, 8 pages.
Notice of Reasons for Rejection in Japanese Application No. 2018-146019 dated Jul. 23, 2019, 8 pages.
Decision of Final Rejection in Japanese Application No. 2018-146019 dated Jan. 21, 2020, 9 pages.
Notice of Reasons for Rejection in Japanese Application No. 2018-146020 dated Jul. 23, 2019, 8 pages.
Notice of Reasons for Rejection in Japanese Application No. 2018-146021 dated Jul. 30, 2019, 8 pages.
Decision to Grant a Patent in Japanese Application No. 2018-146021 dated Jul. 21, 2020, 5 pages.
International Search Report in PCT/CN2020/087002 dated Jul. 14, 2020, 4 pages.
Written Opinion in PCT/CN2020/087002 dated Jul. 14, 2020, 5 pages.
Notice of Preliminary Rejection in Republic of Korea Application No. 10-2018-7007115 dated May 20, 2021, 9 pages.
Notice of Reasons for Refusal in Japanese Application No. 2020-088413 dated Sep. 6, 2022, 11 pages.
The Second Notice of Preliminary Rejection in Korean Application No. 10-2022-7003237 dated Oct. 11, 2022, 14 pages.
Notice of Reasons for Refusal in Japanese Application No. 2021-179711 dated Oct. 18, 2022, 8 pages.
The Office Action in Brazilian Application No. BR112018002854-1 dated Feb. 24, 2023, 8 pages.
Paula Henry et al., Bone Conduction: Anatomy, Physiology, and Communication, Army Research Laboratory, 2007, 206 pages.

* cited by examiner

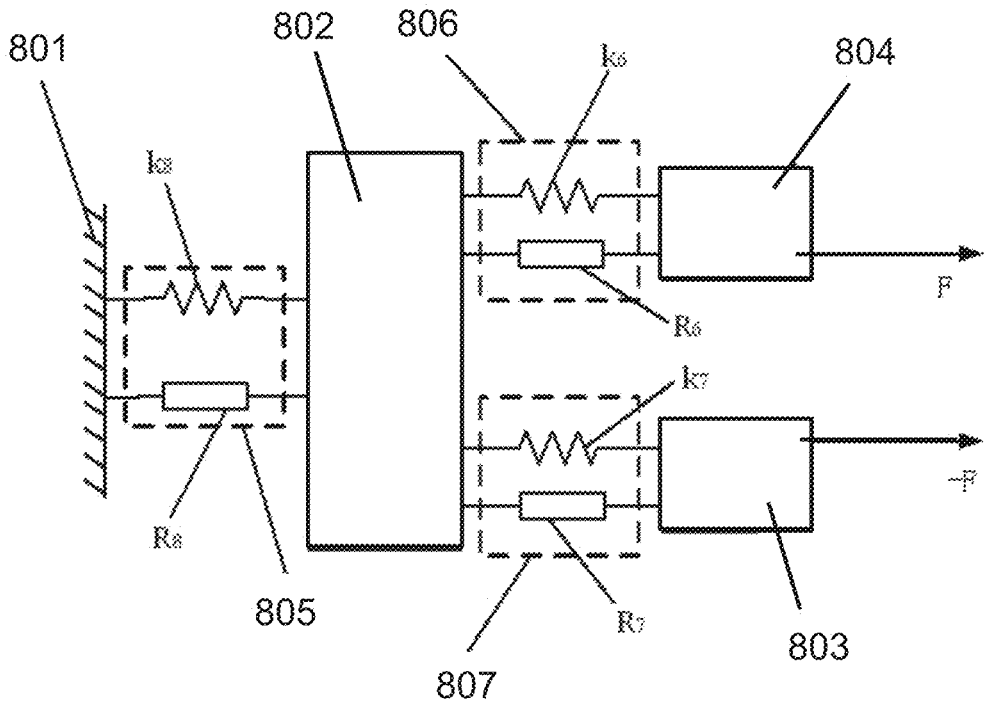
FIG. 8-A

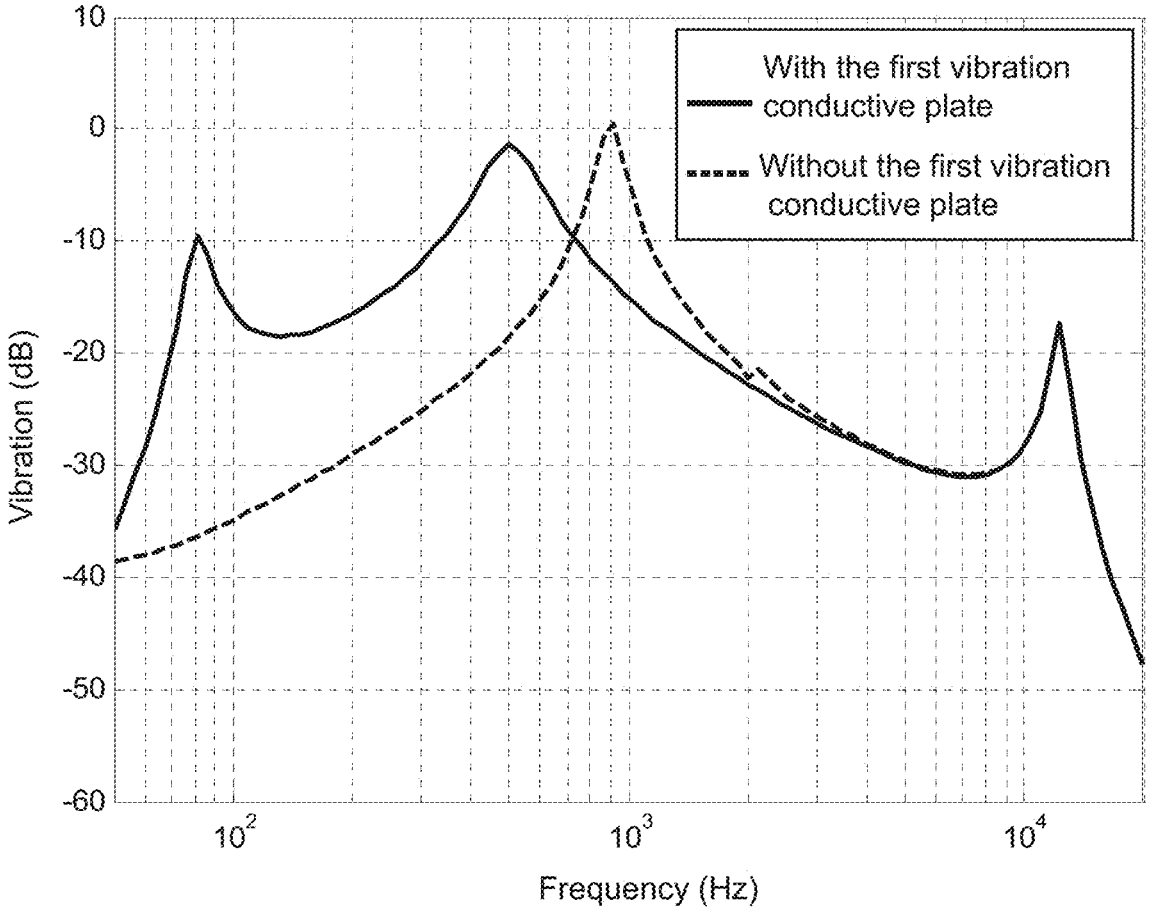
FIG. 8-B

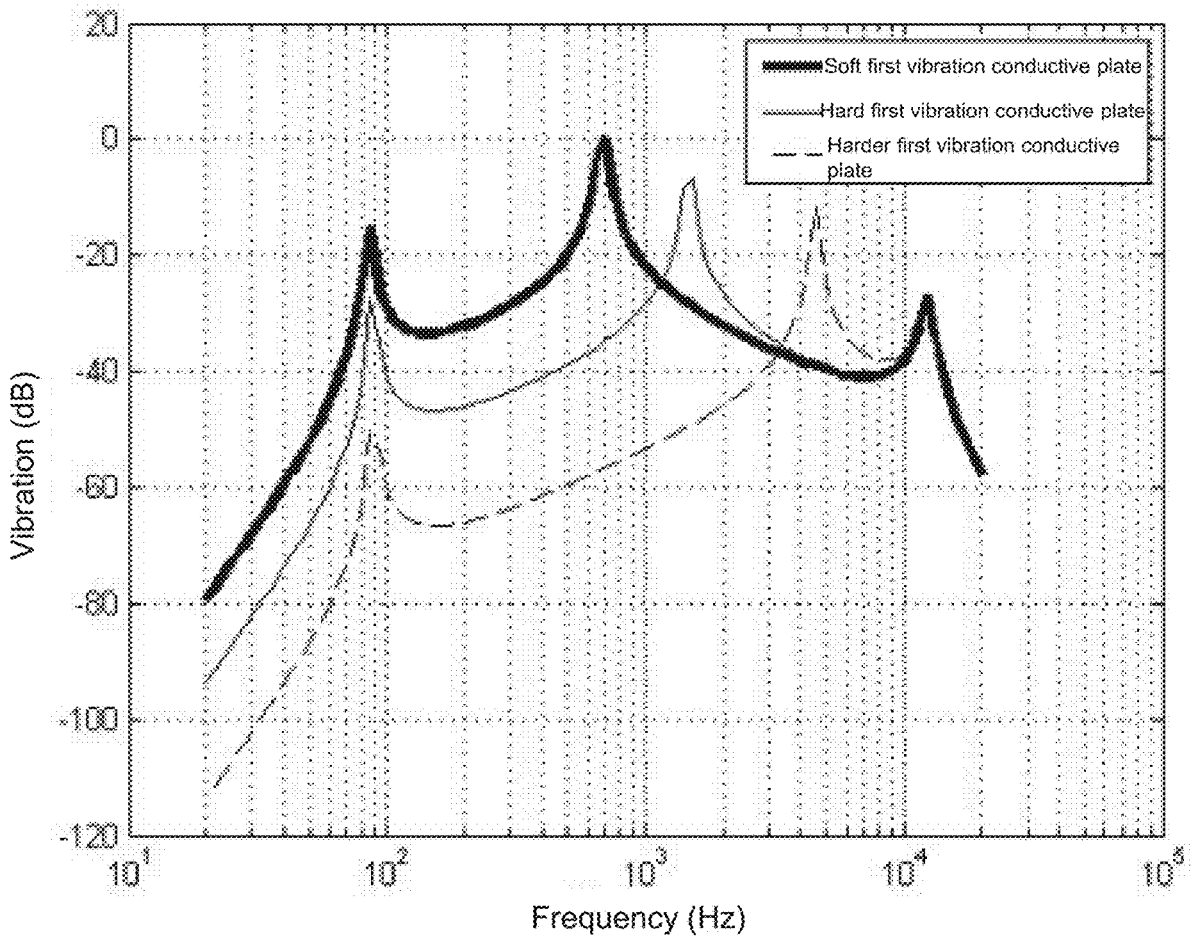
FIG. 8-C

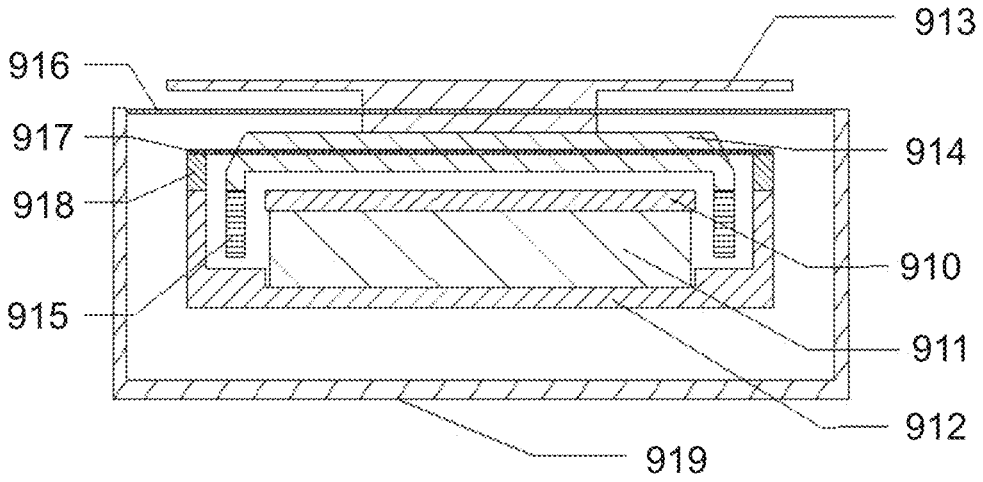
FIG. 9-A

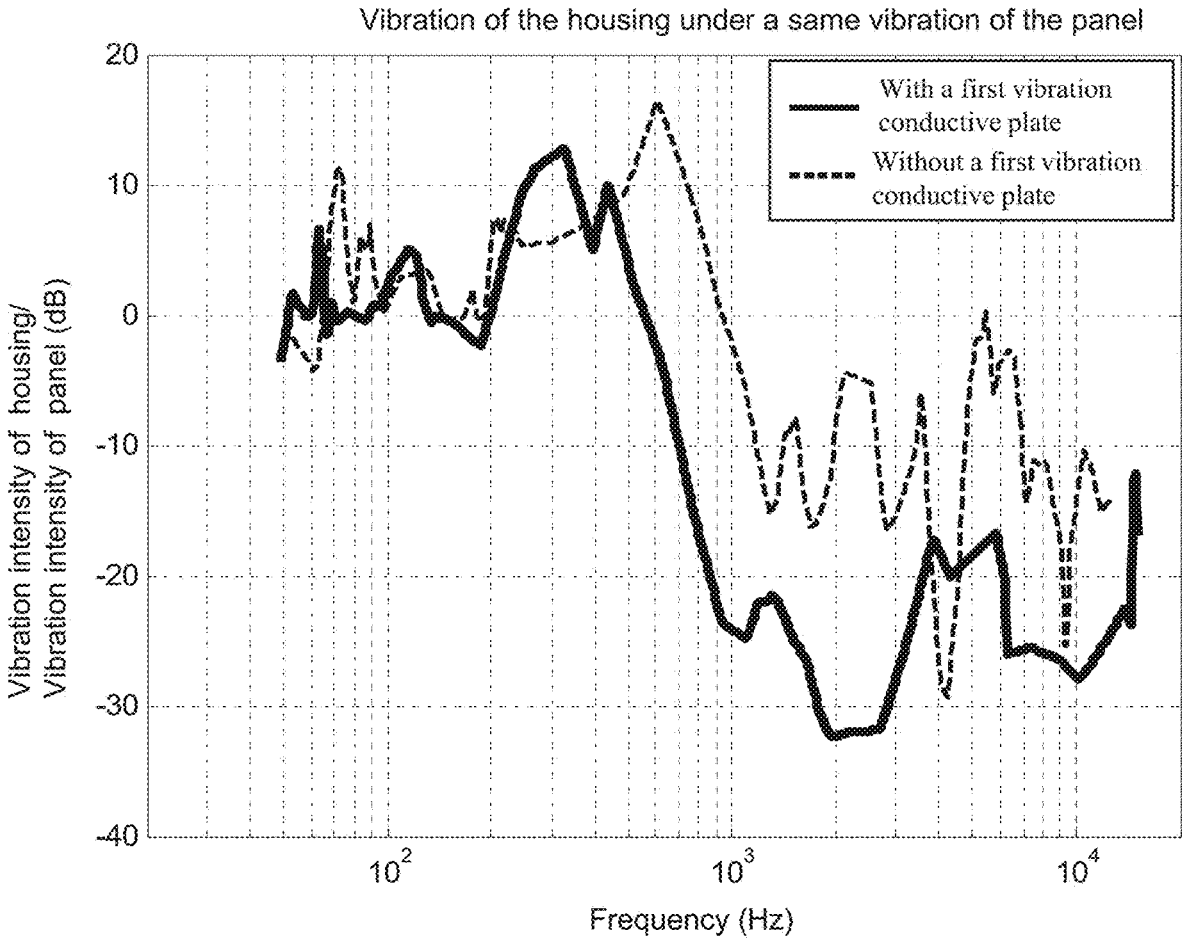
FIG. 9-B

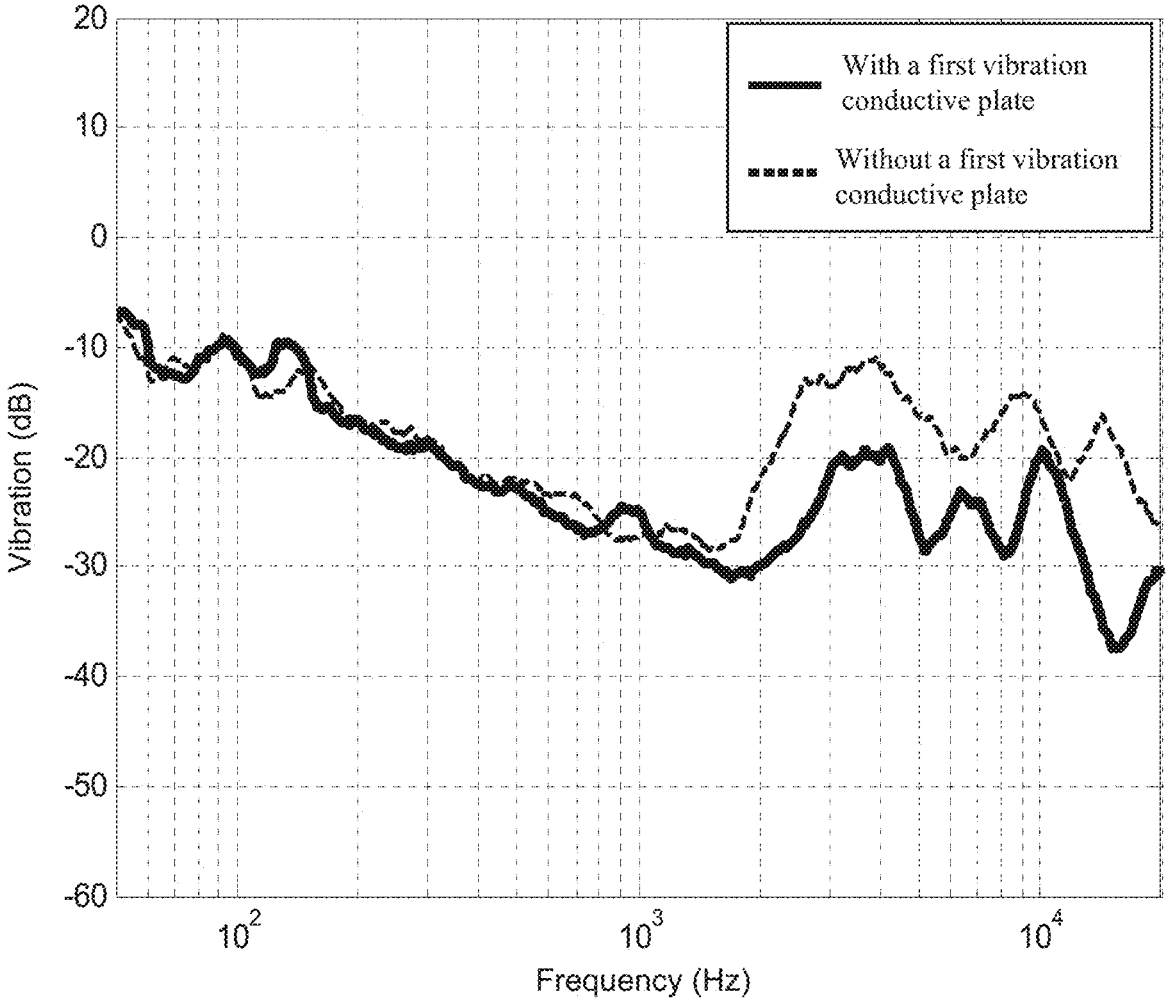
FIG. 9-C

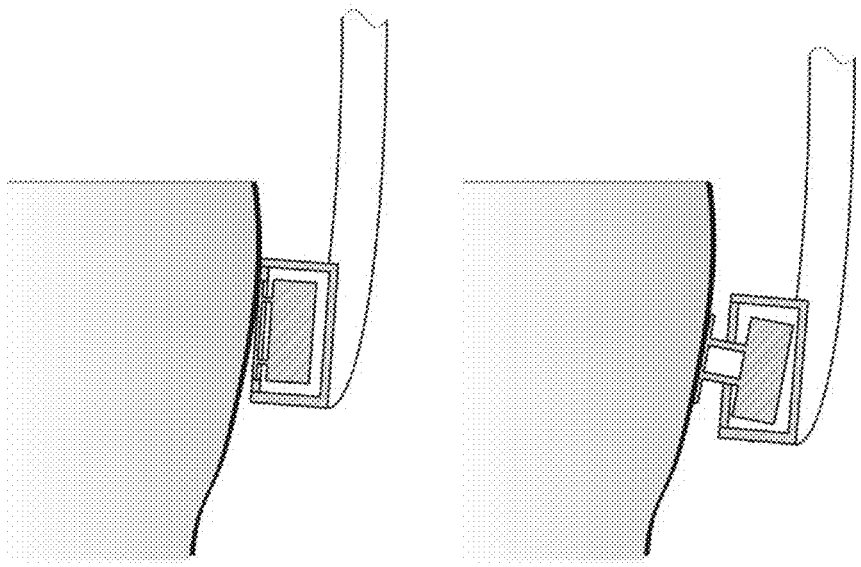
FIG. 11-A

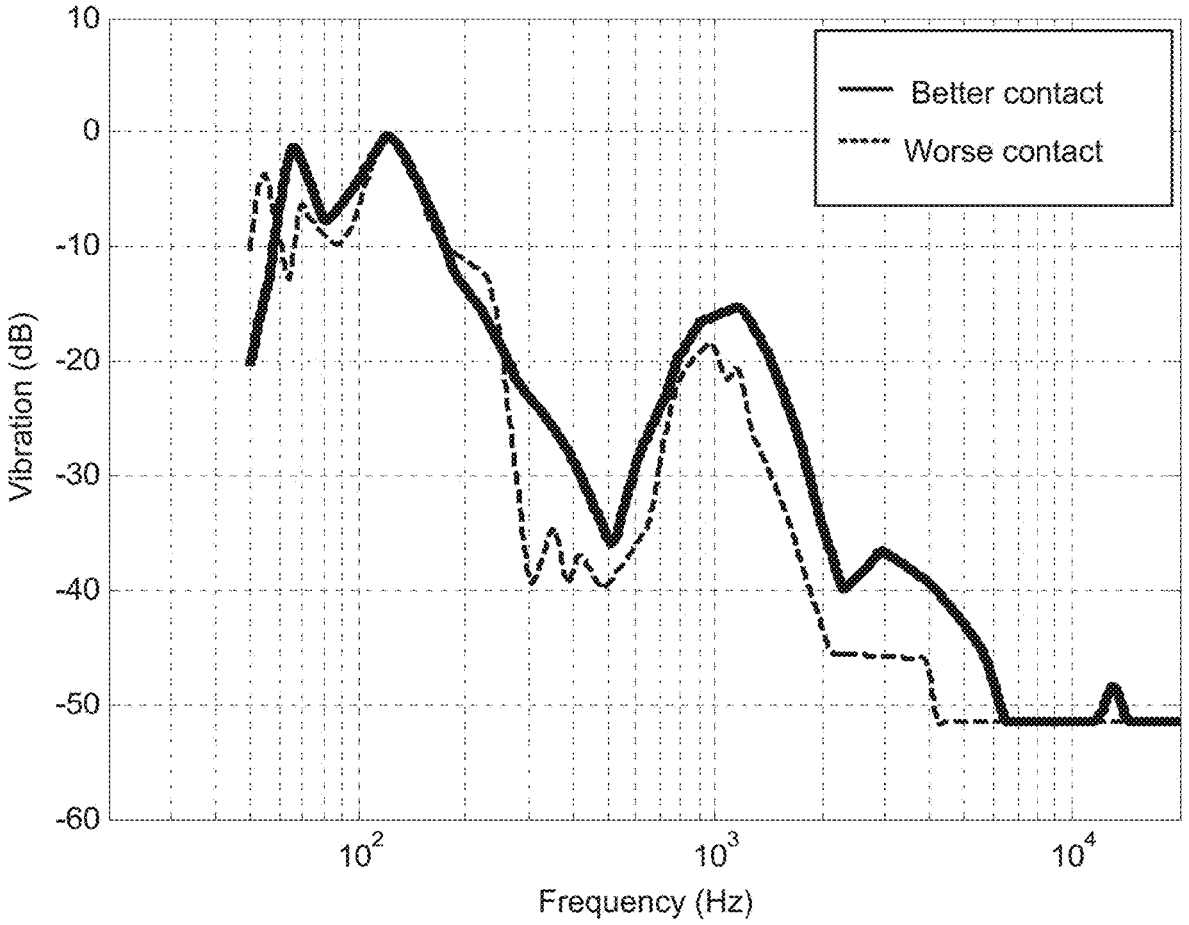
FIG. 11-B

BONE CONDUCTION SPEAKER AND COMPOUND VIBRATION DEVICE THEREOF

CROSS-REFERENCE TO RELATED APPLICATIONS

This application is a continuation-in-part application of U.S. patent application Ser. No. 17/170,817, filed on Feb. 8, 2021, which is a continuation of U.S. patent application Ser. No. 17/161,717, filed on Jan. 29, 2021, which is a continuation-in-part application of U.S. patent application Ser. No. 16/159,070 (issued as U.S. Pat. No. 10,911,876), filed on Oct. 12, 2018, which is a continuation of U.S. patent application Ser. No. 15/197,050 (issued as U.S. Pat. No. 10,117,026), filed on Jun. 29, 2016, which is a continuation of U.S. patent application Ser. No. 14/513,371 (issued as U.S. Pat. No. 9,402,116), filed on Oct. 14, 2014, which is a continuation of U.S. patent application Ser. No. 13/719,754 (issued as U.S. Pat. No. 8,891,792), filed on Dec. 19, 2012, which claims priority to Chinese Patent Application No. 201110438083.9, filed on Dec. 23, 2011; U.S. patent application Ser. No. 17/161,717, filed on Jan. 29, 2021 is also a continuation-in-part application of U.S. patent application Ser. No. 16/833,839, filed on Mar. 30, 2020, which is a continuation of U.S. application Ser. No. 15/752,452 (issued as U.S. Pat. No. 10,609,496), filed on Feb. 13, 2018, which is a national stage entry under 35 U.S.C. § 371 of International Application No. PCT/CN2015/086907, filed on Aug. 13, 2015; this application is also a continuation-in-part of U.S. patent application Ser. No. 17/170,920, filed on Feb. 9, 2021, which is a Continuation of International Application No. PCT/CN2020/087002, filed on Apr. 26, 2020, which claims priority to Chinese Patent Application No. 201910888067.6, filed on Sep. 19, 2019, Chinese Patent Application No. 201910888762.2, filed on Sep. 19, 2019, and Chinese Patent Application No. 201910364346.2, filed on Apr. 30, 2019. Each of the above-referenced applications is hereby incorporated by reference.

TECHNICAL FIELD

The present disclosure relates to improvements on a bone conduction speaker and its components, in detail, relates to a bone conduction speaker and its compound vibration device, while the frequency response of the bone conduction speaker has been improved by the compound vibration device, which is composed of vibration boards and vibration conductive plates.

BACKGROUND

Based on the current technology, the principle that we can hear sounds is that the vibration transferred through the air in our external acoustic meatus, reaches to the ear drum, and the vibration in the ear drum drives our auditory nerves, makes us feel the acoustic vibrations. The current bone conduction speakers are transferring vibrations through our skin, subcutaneous tissues and bones to our auditory nerves, making us hear the sounds.

When the current bone conduction speakers are working, with the vibration of the vibration board, the shell body, fixing the vibration board with some fixers, will also vibrate together with it, thus, when the shell body is touching our post auricles, cheeks, forehead or other parts, the vibrations will be transferred through bones, making us hear the sounds clearly.

However, the frequency response curves generated by the bone conduction speakers with current vibration devices are shown as the two solid lines in FIG. 4. In ideal conditions, the frequency response curve of a speaker is expected to be a straight line, and the top plain area of the curve is expected to be wider, thus the quality of the tone will be better, and easier to be perceived by our ears. However, the current bone conduction speakers, with their frequency response curves shown as FIG. 4, have overtopped resonance peaks either in low frequency area or high frequency area, which has limited its tone quality a lot. Thus, it is very hard to improve the tone quality of current bone conduction speakers containing current vibration devices. The current technology needs to be improved and developed.

SUMMARY

The purpose of the present disclosure is providing a bone conduction speaker and its compound vibration device, to improve the vibration parts in current bone conduction speakers, using a compound vibration device composed of a vibration board and a vibration conductive plate to improve the frequency response of the bone conduction speaker, making it flatter, thus providing a wider range of acoustic sound.

The technical proposal of present disclosure is listed as below:

A compound vibration device in bone conduction speaker contains a vibration conductive plate and a vibration board, the vibration conductive plate is set as the first torus, where at least two first rods in it converge to its center. The vibration board is set as the second torus, where at least two second rods in it converge to its center. The vibration conductive plate is fixed with the vibration board. The first torus is fixed on a magnetic system, and the second torus contains a fixed voice coil, which is driven by the magnetic system.

In the compound vibration device, the magnetic system contains a baseboard, and an annular magnet is set on the board, together with another inner magnet, which is concentrically disposed inside this annular magnet, as well as an inner magnetic conductive plate set on the inner magnet, and the annular magnetic conductive plate set on the annular magnet. A grommet is set on the annular magnetic conductive plate to fix the first torus. The voice coil is set between the inner magnetic conductive plate and the annular magnetic plate.

In the compound vibration device, the number of the first rods and the second rods are both set to be three.

In the compound vibration device, the first rods and the second rods are both straight rods.

In the compound vibration device, there is an indentation at the center of the vibration board, which adapts to the vibration conductive plate.

In the compound vibration device, the vibration conductive plate rods are staggered with the vibration board rods.

In the compound vibration device, the staggered angles between rods are set to be 60 degrees.

In the compound vibration device, the vibration conductive plate is made of stainless steel, with a thickness of 0.1-0.2 mm, and, the width of the first rods in the vibration conductive plate is 0.5-1.0 mm; the width of the second rods in the vibration board is 1.6-2.6 mm, with a thickness of 0.8-1.2 mm.

In the compound vibration device, the number of the vibration conductive plate and the vibration board is set to be more than one. They are fixed together through their centers and/or torus.

A bone conduction speaker comprises a compound vibration device which adopts any methods stated above.

The bone conduction speaker and its compound vibration device as mentioned in the present disclosure, adopting the fixed vibration boards and vibration conductive plates, make the technique simpler with a lower cost. Also, because the two parts in the compound vibration device can adjust low frequency and high frequency areas, the achieved frequency response is flatter and wider, the possible problems like abrupt frequency responses or feeble sound caused by single vibration device will be avoided.

BRIEF DESCRIPTION OF THE DRAWINGS

FIG. 8-A illustrates an equivalent vibration model of the vibration portion of the bone conduction speaker according to some embodiments of the present disclosure;

FIG. 8-B illustrates a vibration response curve of the bone conduction speaker according to one specific embodiment of the present disclosure;

FIG. 8-C illustrates a vibration response curve of the bone conduction speaker according to one specific embodiment of the present disclosure;

FIG. 9-A illustrates a structure of the vibration generation portion of the bone conduction speaker according to one specific embodiment of the present disclosure;

FIG. 9-B illustrates a vibration response curve of the bone conduction speaker according to one specific embodiment of the present disclosure;

FIG. 9-C illustrates a sound leakage curve of the bone conduction speaker according to one specific embodiment of the present disclosure;

FIG. 11-A illustrates an application scenario of the bone conduction speaker according to one specific embodiment of the present disclosure;

FIG. 11-B illustrates a vibration response curve of the bone conduction speaker according to one specific embodiment of the present disclosure;

DETAILED DESCRIPTION

A detailed description of the implements of the present invention is stated here, together with attached figures.

An acoustic output apparatus in the present disclosure may refer to a device having a sound output function. In practical applications, the acoustic output apparatus may be implemented by products of various types, such as speakers (e.g., bone conduction speakers), bracelets, glasses, helmets, watches, clothings, or backpacks. For illustration purposes, a bone conduction speaker and a pair of glasses with a sound output function may be provided as an example of the acoustic output apparatus. Exemplary glasses may include myopia glasses, sports glasses, hyperopia glasses, reading glasses, astigmatism lenses, wind/sand-proof glasses, sunglasses, ultraviolet-proof glasses, welding mirrors, infrared-proof mirrors, and virtual reality (VR) glasses, augmented Reality (AR) glasses, mixed reality (MR) glasses, mediated reality glasses, or the like, or any combination thereof.

Figure 1:
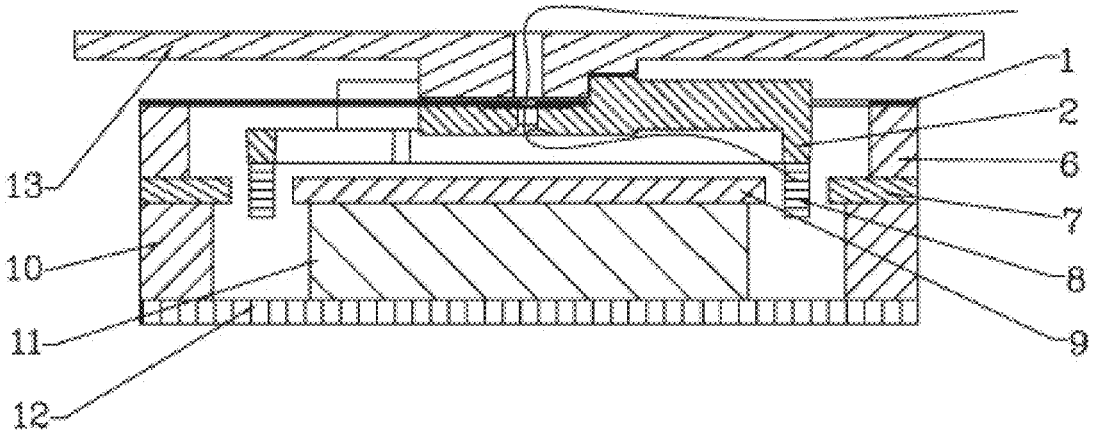
FIG. 1 illustrates a longitudinal section view of the bone conduction speaker in the present disclosure.
Figure 2:
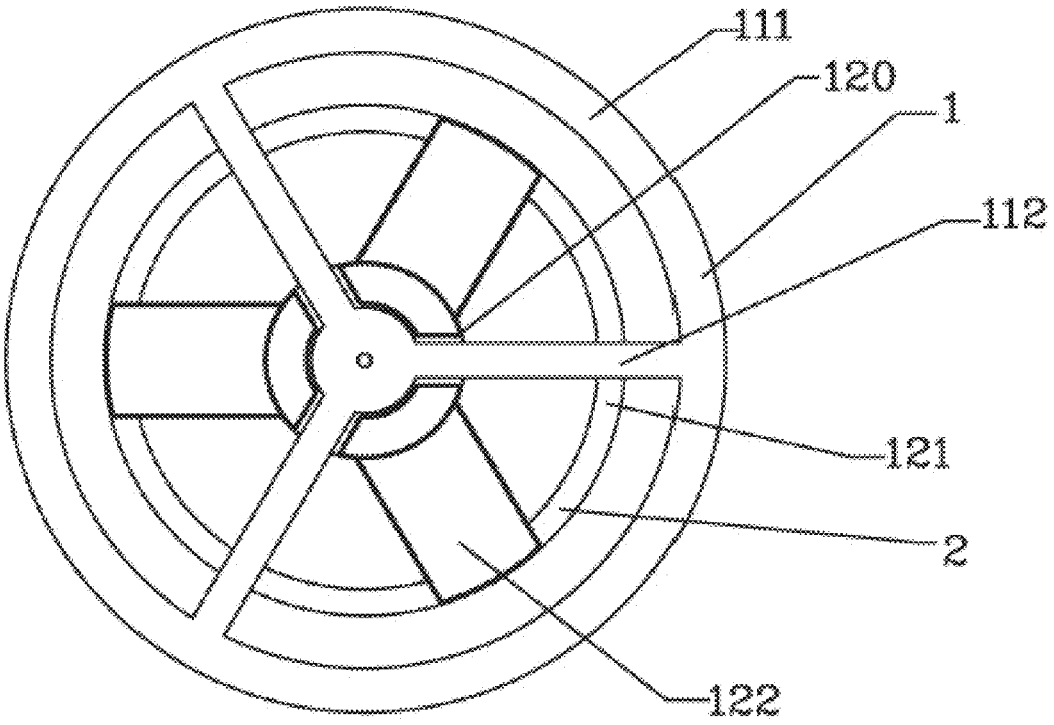
FIG. 2 illustrates a perspective view of the vibration parts in the bone conduction speaker in the present disclosure.
Figure 3:
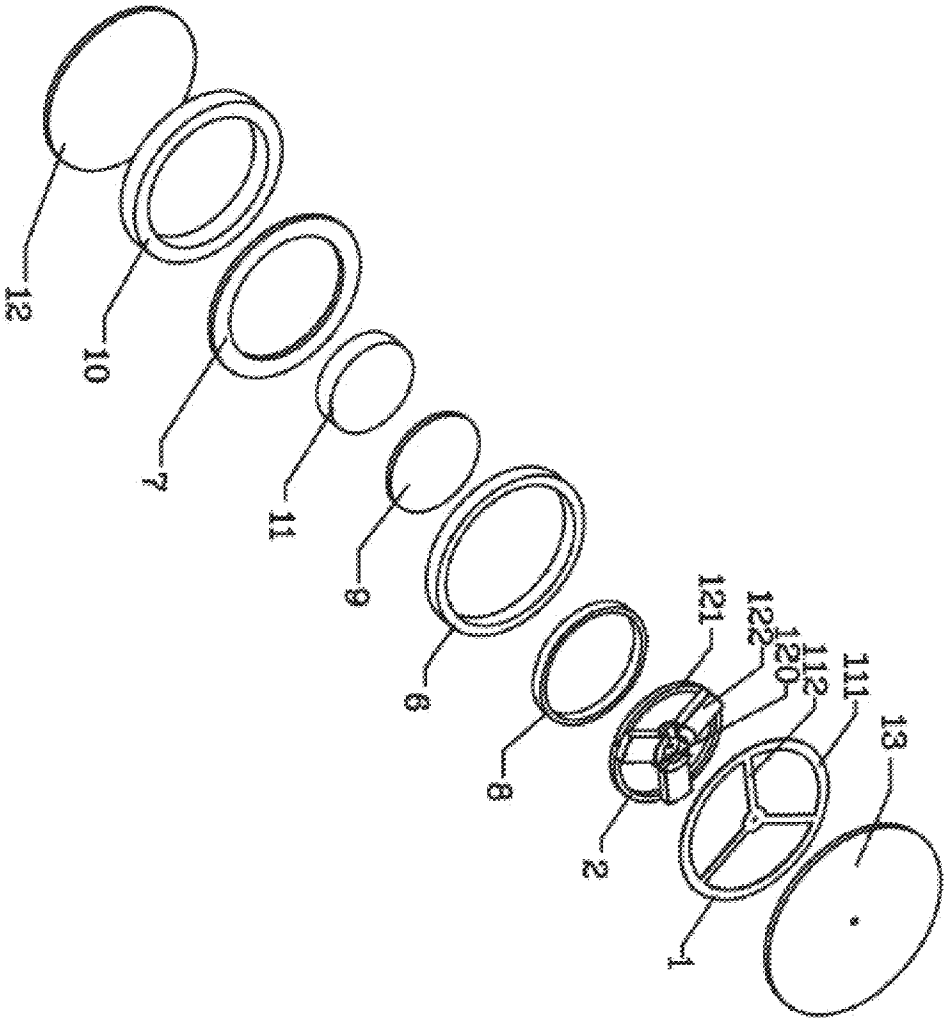
FIG. 3 illustrates an exploded perspective view of the bone conduction speaker in the present disclosure.

As shown in FIG. 1 and FIG. 3, the compound vibration device in the present disclosure of bone conduction speaker, comprises: the compound vibration parts composed of vibration conductive plate 1 and vibration board 2, the vibration conductive plate 1 is set as the first torus 111 and three first rods 112 in the first torus converging to the center of the torus, the converging center is fixed with the center of the vibration board 2. The center of the vibration board 2 is an indentation 120, which matches the converging center and the first rods. The vibration board 2 contains a second torus 121, which has a smaller radius than the vibration conductive plate 1, as well as three second rods 122, which is thicker and wider than the first rods 112. The first rods 112 and the second rods 122 are staggered, present but not limited to an angle of 60 degrees, as shown in FIG. 2. A better solution is, both the first and second rods are all straight rods.

Obviously the number of the first and second rods can be more than two, for example, if there are two rods, they can be set in a symmetrical position; however, the most economic design is working with three rods. Not limited to this rods setting mode, the setting of rods in the present disclosure can also be a spoke structure with four, five or more rods.

The vibration conductive plate 1 is very thin and can be more elastic, which is stuck at the center of the indentation 120 of the vibration board 2. Below the second torus 121 spliced in vibration board 2 is a voice coil 8. The compound vibration device in the present disclosure also comprises a bottom plate 12, where an annular magnet 10 is set, and an inner magnet 11 is set in the annular magnet 10 concentrically. An inner magnet conduction plate 9 is set on the top of the inner magnet 11, while annular magnet conduction plate 7 is set on the annular magnet 10, a grommet 6 is fixed above the annular magnet conduction plate 7, the first torus 111 of the vibration conductive plate 1 is fixed with the grommet 6. The whole compound vibration device is connected to the outside through a panel 13, the panel 13 is fixed with the vibration conductive plate 1 on its converging center, stuck and fixed at the center of both vibration conductive plate 1 and vibration board 2.

It should be noted that, both the vibration conductive plate and the vibration board can be set more than one, fixed with each other through either the center or staggered with both center and edge, forming a multilayer vibration structure, corresponding to different frequency resonance ranges, thus achieve a high tone quality earphone vibration unit with a gamut and full frequency range, despite of the higher cost.

The bone conduction speaker contains a magnet system, composed of the annular magnet conductive plate 7, annular magnet 10, bottom plate 12, inner magnet 11 and inner magnet conductive plate 9, because the changes of audio-frequency current in the voice coil 8 cause changes of magnet field, which makes the voice coil 8 vibrate. The compound vibration device is connected to the magnet system through grommet 6. The bone conduction speaker connects with the outside through the panel 13, being able to transfer vibrations to human bones.

Figure 6:
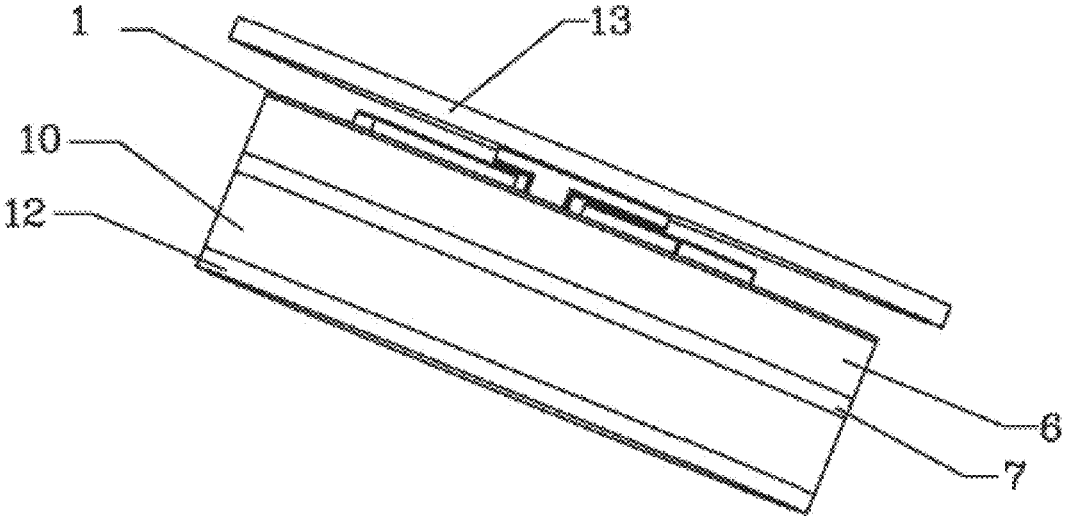
FIG. 6 illustrates a perspective view of the bone conduction speaker in the present disclosure.

In the better implement examples of the present bone conduction speaker and its compound vibration device, the magnet system, composed of the annular magnet conductive plate 7, annular magnet 10, inner magnet conduction plate 9, inner magnet 11 and bottom plate 12, interacts with the voice coil which generates changing magnet field intensity when its current is changing, and inductance changes accordingly, forces the voice coil 8 move longitudinally, then causes the vibration board 2 to vibrate, transfers the vibration to the vibration conductive plate 1, then, through the contact between panel 13 and the post ear, cheeks or forehead of the human beings, transfers the vibrations to human bones, thus generates sounds. A complete product unit is shown in FIG. 6.

Figure 5:
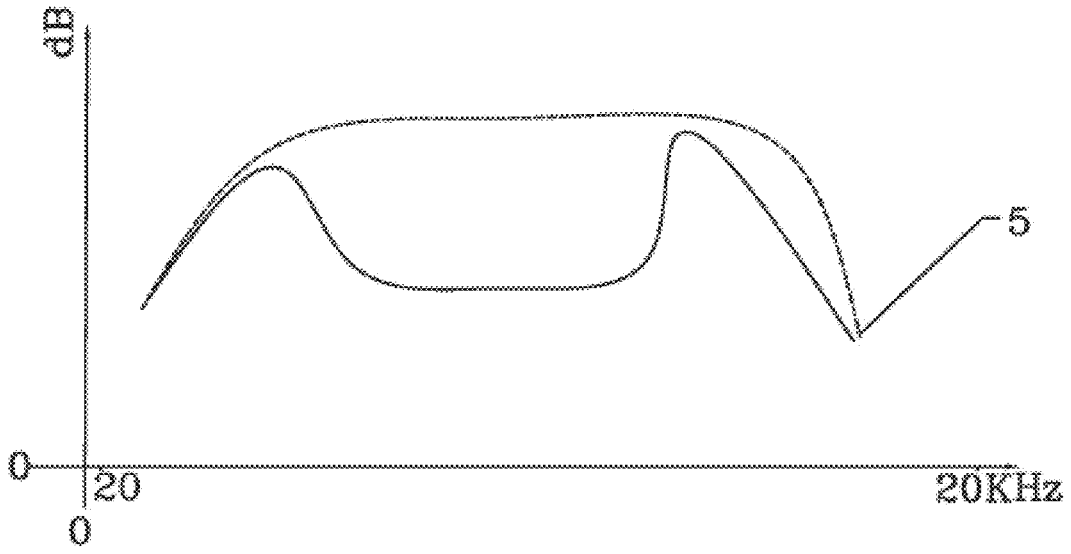
FIG. 5 illustrates a frequency response curves of the bone conduction speakers of the vibration device in the present disclosure.

Through the compound vibration device composed of the vibration board and the vibration conductive plate, a frequency response shown in FIG. 5 is achieved. The double compound vibration generates two resonance peaks, whose positions can be changed by adjusting the parameters including sizes and materials of the two vibration parts, making the resonance peak in low frequency area move to the lower frequency area and the peak in high frequency move higher, finally generates a frequency response curve as the dotted line shown in FIG. 5, which is a flat frequency response curve generated in an ideal condition, whose resonance peaks are among the frequencies catchable with human ears. Thus, the device widens the resonance oscillation ranges, and generates the ideal voices.

In some embodiments, the stiffness of the vibration board may be larger than that of the vibration conductive plate. In some embodiments, the resonance peaks of the frequency response curve may be set within a frequency range perceivable by human ears, or a frequency range that a person's ears may not hear. Preferably, the two resonance peaks may be beyond the frequency range that a person may hear. More preferably, one resonance peak may be within the frequency range perceivable by human ears, and another one may be beyond the frequency range that a person may hear. More preferably, the two resonance peaks may be within the frequency range perceivable by human ears. Further preferably, the two resonance peaks may be within the frequency range perceivable by human ears, and the peak frequency may be in a range of 80 Hz-18000 Hz. Further preferably, the two resonance peaks may be within the frequency range perceivable by human ears, and the peak frequency may be in a range of 200 Hz-15000 Hz. Further preferably, the two resonance peaks may be within the frequency range perceivable by human ears, and the peak frequency may be in a range of 500 Hz-12000 Hz. Further preferably, the two resonance peaks may be within the frequency range perceivable by human ears, and the peak frequency may be in a range of 800 Hz-11000 Hz. There may be a difference between the frequency values of the resonance peaks. For example, the difference between the frequency values of the two resonance peaks may be at least 500 Hz, preferably 1000 Hz, more preferably 2000 Hz, and more preferably 5000 Hz. To achieve a better effect, the two resonance peaks may be within the frequency range perceivable by human ears, and the difference between the frequency values of the two resonance peaks may be at least 500 Hz. Preferably, the two resonance peaks may be within the frequency range perceivable by human ears, and the difference between the frequency values of the two resonance peaks may be at least 1000 Hz. More preferably, the two resonance peaks may be within the frequency range perceivable by human ears, and the difference between the frequency values of the two resonance peaks may be at least 2000 Hz. More preferably, the two resonance peaks may be within the frequency range perceivable by human ears, and the difference between the frequency values of the two resonance peaks may be at least 3000 Hz. Moreover, more preferably, the two resonance peaks may be within the frequency range perceivable by human ears, and the difference between the frequency values of the two resonance peaks may be at least 4000 Hz. One resonance peak may be within the frequency range perceivable by human ears, another one may be beyond the frequency range that a person may hear, and the difference between the frequency values of the two resonance peaks may be at least 500 Hz. Preferably, one resonance peak may be within the frequency range perceivable by human ears, another one may be beyond the frequency range that a person may hear, and the difference between the frequency values of the two resonance peaks may be at least 1000 Hz. More preferably, one resonance peak may be within the frequency range perceivable by human ears, another one may be beyond the frequency range that a person may hear, and the difference between the frequency values of the two resonance peaks may be at least 2000 Hz. More preferably, one resonance peak may be within the frequency range perceivable by human ears, another one may be beyond the frequency range that a person may hear, and the difference between the frequency values of the two resonance peaks may be at least 3000 Hz. Moreover, more preferably, one resonance peak may be within the frequency range perceivable by human ears, another one may be beyond the frequency range that a person may hear, and the difference between the frequency values of the two resonance peaks may be at least 4000 Hz. Both resonance peaks may be within the frequency range of 5 Hz-30000 Hz, and the difference between the frequency values of the two resonance peaks may be at least 400 Hz. Preferably, both resonance peaks may be within the frequency range of 5 Hz-30000 Hz, and the difference between the frequency values of the two resonance peaks may be at least 1000 Hz. More preferably, both resonance peaks may be within the frequency range of 5 Hz-30000 Hz, and the difference between the frequency values of the two resonance peaks may be at least 2000 Hz. More preferably, both resonance peaks may be within the frequency range of 5 Hz-30000 Hz, and the difference between the frequency values of the two resonance peaks may be at least 3000 Hz. Moreover, further preferably, both resonance peaks may be within the frequency range of 5 Hz-30000 Hz, and the difference between the frequency values of the two resonance peaks may be at least 4000 Hz. Both resonance peaks may be within the frequency range of 20 Hz-20000 Hz, and the difference between the frequency values of the two resonance peaks may be at least 400 Hz. Preferably, both resonance peaks may be within the frequency range of 20 Hz-2000 Hz, and the difference between the frequency values of the two resonance peaks may be at least 1000 Hz. More preferably, both resonance peaks may be within the frequency range of 20 Hz-20000 Hz, and the difference between the frequency values of the two resonance peaks may be at least 2000 Hz. More preferably, both resonance peaks may be within the frequency range of 20 Hz-20000 Hz, and the difference between the frequency values of the two resonance peaks may be at least 3000 Hz. And further preferably, both resonance peaks may be within the frequency range of 20 Hz-20000 Hz, and the difference between the frequency values of the two resonance peaks may be at least 4000 Hz. Both the two resonance peaks may be within the frequency range of 100 Hz-18000 Hz, and the difference between the frequency values of the two resonance peaks may be at least 400 Hz. Preferably, both resonance peaks may be within the frequency range of 100 Hz-18000 Hz, and the difference between the frequency values of the two resonance peaks may be at least 1000 Hz. More preferably, both resonance peaks may be within the frequency range of 100 Hz-18000 Hz, and the difference between the frequency values of the two resonance peaks may be at least 2000 Hz. More preferably, both resonance peaks may be within the frequency range of 100 Hz-18000 Hz, and the difference between the frequency values of the two resonance peaks may be at least 3000 Hz. And further preferably, both resonance peaks may be within the frequency range of 100 Hz-18000 Hz, and the difference between the frequency values of the two resonance peaks may be at least 4000 Hz. Both the two resonance peaks may be within the frequency range of 200 Hz-12000 Hz, and the difference between the frequency values of the two resonance peaks may be at least 400 Hz. Preferably, both resonance peaks may be within the frequency range of 200 Hz-12000 Hz, and the difference between the frequency values of the two resonance peaks may be at least 1000 Hz. More preferably, both resonance peaks may be within the frequency range of 200 Hz-12000 Hz, and the difference between the frequency values of the two resonance peaks may be at least 2000 Hz. More preferably, both resonance peaks may be within the frequency range of 200 Hz-12000 Hz, and the difference between the frequency values of the two resonance peaks may be at least 3000 Hz. And further preferably, both resonance peaks may be within the frequency range of 200 Hz-12000 Hz, and the difference between the frequency values of the two resonance peaks may be at least 4000 Hz. Both the two resonance peaks may be within the frequency range of 500 Hz-10000 Hz, and the difference between the frequency values of the two resonance peaks may be at least 400 Hz. Preferably, both resonance peaks may be within the frequency range of 500 Hz-10000 Hz, and the difference between the frequency values of the two resonance peaks may be at least 1000 Hz. More preferably, both resonance peaks may be within the frequency range of 500 Hz-10000 Hz, and the difference between the frequency values of the two resonance peaks may be at least 2000 Hz. More preferably, both resonance peaks may be within the frequency range of 500 Hz-10000 Hz, and the difference between the frequency values of the two resonance peaks may be at least 3000 Hz. And further preferably, both resonance peaks may be within the frequency range of 500 Hz-10000 Hz, and the difference between the frequency values of the two resonance peaks may be at least 4000 Hz. This may broaden the range of the resonance response of the speaker, thus obtaining a more ideal sound quality. It should be noted that in actual applications, there may be multiple vibration conductive plates and vibration boards to form multi-layer vibration structures corresponding to different ranges of frequency response, thus obtaining diatonic, full-ranged and high-quality vibrations of the speaker, or may make the frequency response curve meet requirements in a specific frequency range. For example, to satisfy the requirement of normal hearing, a bone conduction hearing aid may be configured to have a transducer including one or more vibration boards and vibration conductive plates with a resonance frequency in a range of 100 Hz-10000 Hz.

In the better implement examples, but, not limited to these examples, it is adopted that, the vibration conductive plate can be made by stainless steels, with a thickness of 0.1-0.2 mm, and when the middle three rods of the first rods group in the vibration conductive plate have a width of 0.5-1.0 mm, the low frequency resonance oscillation peak of the bone conduction speaker is located between 300 and 900 Hz. And, when the three straight rods in the second rods group have a width between 1.6 and 2.6 mm, and a thickness between 0.8 and 1.2 mm, the high frequency resonance oscillation peak of the bone conduction speaker is between 7500 and 9500 Hz. Also, the structures of the vibration conductive plate and the vibration board is not limited to three straight rods, as long as their structures can make a suitable flexibility to both vibration conductive plate and vibration board, cross-shaped rods and other rod structures are also suitable. Of course, with more compound vibration parts, more resonance oscillation peaks will be achieved, and the fitting curve will be flatter and the sound wider. Thus, in the better implement examples, more than two vibration parts, including the vibration conductive plate and vibration board as well as similar parts, overlapping each other, is also applicable, just needs more costs.

Figure 7:
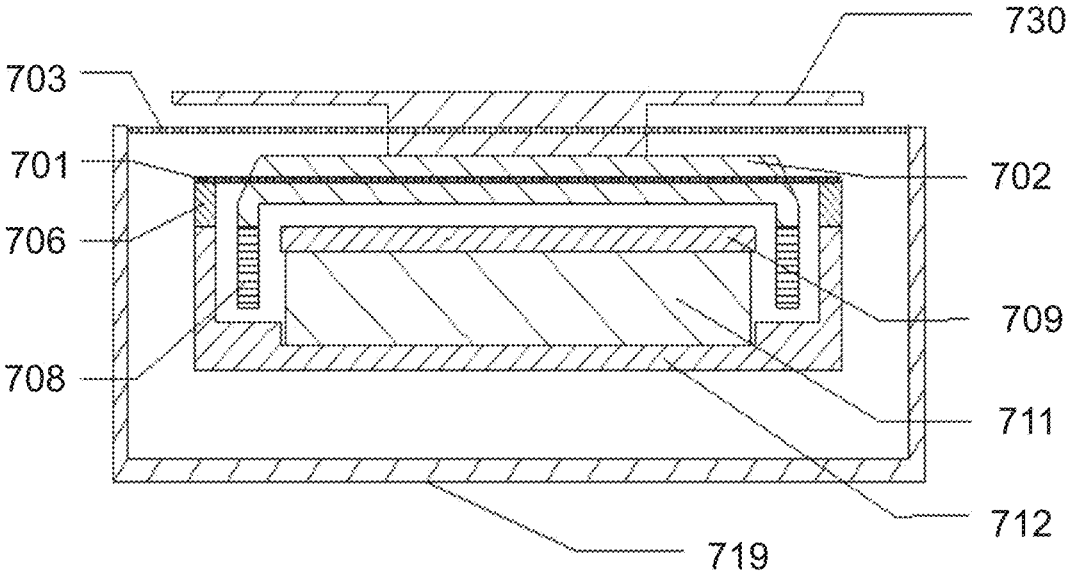
FIG. 7 illustrates a structure of the bone conduction speaker and the compound vibration device according to some embodiments of the present disclosure.

As shown in FIG. 7, in another embodiment, the compound vibration device (also referred to as "compound vibration system") may include a vibration board 702, a first vibration conductive plate 703, and a second vibration conductive plate 701. The first vibration conductive plate 703 may fix the vibration board 702 and the second vibration conductive plate 701 onto a housing 719. The compound vibration system including the vibration board 702, the first vibration conductive plate 703, and the second vibration conductive plate 701 may lead to no less than two resonance peaks and a smoother frequency response curve in the range of the auditory system, thus improving the sound quality of the bone conduction speaker. The equivalent model of the compound vibration system may be shown in FIG. 8-A:

For illustration purposes, 801 represents a housing, 802 represents a panel, 803 represents a voice coil, 804 represents a magnetic circuit system, 805 represents a first vibration conductive plate, 806 represents a second vibration conductive plate, and 807 represents a vibration board. The first vibration conductive plate, the second vibration conductive plate, and the vibration board may be abstracted as components with elasticity and damping; the housing, the panel, the voice coil and the magnetic circuit system may be abstracted as equivalent mass blocks. The vibration equation of the system may be expressed as:

$$m_6x_6''+R_6(x_6-x_5)'+k_6(x_6-x_5)=F, \tag{1}$$

$$x_7''+R_7(x_7-x_5)'+k_7(x_7-x_5)=-F, \tag{2}$$

$$m_5x_5''-R_6(x_6-x_5)'-R_7(x_7-x_5)'+R_8x_5'+k_8x_5-k_6(x_6-x_5)-k_7(x_7-x_5)=0, \tag{3}$$

wherein, F is a driving force, $k_6$ is an equivalent stiffness coefficient of the second vibration conductive plate, $k_7$ is an equivalent stiffness coefficient of the vibration board, $k_8$ is an equivalent stiffness coefficient of the first vibration conductive plate, $R_6$ is an equivalent damping of the second vibration conductive plate, $R_7$ is an equivalent damping of the vibration board, $R_8$ is an equivalent damp of the first vibration conductive plate, $m_5$ is a mass of the panel, $m_6$ is a mass of the magnetic circuit system, $m_7$ is a mass of the voice coil, $x_5$ is a displacement of the panel, $x_6$ is a displacement of the magnetic circuit system, $x_7$ is ta displacement of the voice coil, and the amplitude of the panel 802 may be:

$$A_5=\frac{(-m_6\omega^2(jR_7\omega-k_7)+m_7\omega^2(jR_6\omega-k_6))}{((-m_5\omega^2-jR_8\omega+k_8((-m_6\omega^2-jR_6\omega+k_6)(-m_7\omega^2-jR_7\omega+k_7)-m_6\omega^2(-jR_6\omega+k_6)(-m_7\omega^2-jR_7\omega+k_7)-m_7\omega^2(-jR_7\omega+k_7)(-m_6\omega^2-jR_6\omega+k_6))}f_0, \tag{4}$$

wherein ω is an angular frequency of the vibration, and $f_0$ is a unit driving force.

The vibration system of the bone conduction speaker may transfer vibrations to a user via a panel (e.g., the panel 730 shown in FIG. 7). According to the equation (4), the vibration efficiency may relate to the stiffness coefficients of the vibration board, the first vibration conductive plate, and the second vibration conductive plate, and the vibration damping. Preferably, the stiffness coefficient of the vibration board $k_7$ may be greater than the second vibration coefficient $k_6$, and the stiffness coefficient of the vibration board $k_7$ may be greater than the first vibration factor $k_8$. The number of resonance peaks generated by the compound vibration system with the first vibration conductive plate may be more than the compound vibration system without the first vibration conductive plate, preferably at least three resonance peaks. More preferably, at least one resonance peak may be beyond the range perceivable by human ears. More preferably, the resonance peaks may be within the range perceivable by human ears. More further preferably, the resonance peaks may be within the range perceivable by human ears, and the frequency peak value may be no more than 18000 Hz. More preferably, the resonance peaks may be within the range perceivable by human ears, and the frequency peak value may be within the frequency range of 100 Hz-15000 Hz. More preferably, the resonance peaks may be within the range perceivable by human ears, and the frequency peak value may be within the frequency range of 200 Hz-12000 Hz. More preferably, the resonance peaks may be within the range perceivable by human ears, and the frequency peak value may be within the frequency range of 500 Hz-11000 Hz. There may be differences between the frequency values of the resonance peaks. For example, there may be at least two resonance peaks with a difference of the frequency values between the two resonance peaks no less than 200 Hz. Preferably, there may be at least two resonance peaks with a difference of the frequency values between the two resonance peaks no less than 500 Hz. More preferably, there may be at least two resonance peaks with a difference of the frequency values between the two resonance peaks no less than 1000 Hz. More preferably, there may be at least two resonance peaks with a difference of the frequency values between the two resonance peaks no less than 2000 Hz. More preferably, there may be at least two resonance peaks with a difference of the frequency values between the two resonance peaks no less than 5000 Hz. To achieve a better effect, all of the resonance peaks may be within the range perceivable by human ears, and there may be at least two resonance peaks with a difference of the frequency values between the two resonance peaks no less than 500 Hz. Preferably, all of the resonance peaks may be within the range perceivable by human ears, and there may be at least two resonance peaks with a difference of the frequency values between the two resonance peaks no less than 1000 Hz. More preferably, all of the resonance peaks may be within the range perceivable by human ears, and there may be at least two resonance peaks with a difference of the frequency values between the two resonance peaks no less than 2000 Hz. More preferably, all of the resonance peaks may be within the range perceivable by human ears, and there may be at least two resonance peaks with a difference of the frequency values between the two resonance peaks no less than 3000 Hz. More preferably, all of the resonance peaks may be within the range perceivable by human ears, and there may be at least two resonance peaks with a difference of the frequency values between the two resonance peaks no less than 4000 Hz. Two of the three resonance peaks may be within the frequency range perceivable by human ears, and another one may be beyond the frequency range that a person may hear, and there may be at least two resonance peaks with a difference of the frequency values between the two resonance peaks no less than 500 Hz. Preferably, two of the three resonance peaks may be within the frequency range perceivable by human ears, and another one may be beyond the frequency range that a person may hear, and there may be at least two resonance peaks with a difference of the frequency values between the two resonance peaks no less than 1000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 2000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 3000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 4000 Hz. One of the three resonance peaks may be within the frequency range perceivable by human ears, and the other two may be beyond the frequency range that a person may hear, and there may be at least two resonance peaks with a difference of the frequency values between the two resonance peaks no less than 500 Hz. Preferably, one of the three resonance peaks may be within the frequency range perceivable by human ears, and the other two may be beyond the frequency range that a person may hear, and there may be at least two resonance peaks with a difference of the frequency values between the two resonance peaks no less than 1000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 2000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 3000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 4000 Hz. All the resonance peaks may be within the frequency range of 5 Hz-30000 Hz, and there may be at least two resonance peaks with a difference of the frequency values between the two resonance peaks of at least 400 Hz. Preferably, all the resonance peaks may be within the frequency range of 5 Hz-30000 Hz, and there may be at least two resonance peaks with a difference of the frequency values between the two resonance peaks of at least 1000 Hz. More preferably, all the resonance peaks may be within the frequency range of 5 Hz-30000 Hz, and there may be at least two resonance peaks with a difference of the frequency values between the two resonance peaks of at least 2000 Hz. More preferably, all the resonance peaks may be within the frequency range of 5 Hz-30000 Hz, and there may be at least two resonance peaks with a difference of the frequency values between the two resonance peaks of at least 3000 Hz. And further preferably, all the resonance peaks may be within the frequency range of 5 Hz-30000 Hz, and there may be at least two resonance peaks with a difference of the frequency values between the two resonance peaks of at least 4000 Hz. All the resonance peaks may be within the frequency range of 20 Hz-20000 Hz, and there may be at least two resonance peaks with a difference of the frequency values between the two resonance peaks of at least 400 Hz. Preferably, all the resonance peaks may be within the frequency range of 20 Hz-2000 Hz, and there may be at least two resonance peaks with a difference of the frequency values between the two resonance peaks of at least 1000 Hz. More preferably, all the resonance peaks may be within the frequency range of 20 Hz-20000 Hz, and there may be at least two resonance peaks with a difference of the frequency values between the two resonance peaks of at least 2000 Hz. More preferably, all the resonance peaks may be within the frequency range of 20 Hz-20000 Hz, and there may be at least two resonance peaks with a difference of the frequency values between the two resonance peaks of at least 3000 Hz. And further preferably, all the resonance peaks may be within the frequency range of 20 Hz-20000 Hz, and there may be at least two resonance peaks with a difference of the frequency values between the two resonance peaks of at least 4000 Hz. All the resonance peaks may be within the frequency range of 100 Hz-18000 Hz, and there may be at least two resonance peaks with a difference of the frequency values between the two resonance peaks of at least 400 Hz. Preferably, all the resonance peaks may be within the frequency range of 100 Hz-18000 Hz, and there may be at least two resonance peaks with a difference of the frequency values between the two resonance peaks of at least 1000 Hz. More preferably, all the resonance peaks may be within the frequency range of 100 Hz-18000 Hz, and there may be at least two resonance peaks with a difference of the frequency values between the two resonance peaks of at least 2000 Hz. More preferably, all the resonance peaks may be within the frequency range of 100 Hz-18000 Hz, and there may be at least two resonance peaks with a difference of the frequency values between the two resonance peaks of at least 3000 Hz. And further preferably, all the resonance peaks may be within the frequency range of 100 Hz-18000 Hz, and there may be at least two resonance peaks with a difference of the frequency values between the two resonance peaks of at least 4000 Hz. All the resonance peaks may be within the frequency range of 200 Hz-12000 Hz, and there may be at least two resonance peaks with a difference of the frequency values between the two resonance peaks of at least 400 Hz. Preferably, all the resonance peaks may be within the frequency range of 200 Hz-12000 Hz, and there may be at least two resonance peaks with a difference of the frequency values between the two resonance peaks of at least 1000 Hz. More preferably, all the resonance peaks may be within the frequency range of 200 Hz-12000 Hz, and there may be at least two resonance peaks with a difference of the frequency values between the two resonance peaks of at least 2000 Hz. More preferably, all the resonance peaks may be within the frequency range of 200 Hz-12000 Hz, and there may be at least two resonance peaks with a difference of the frequency values between the two resonance peaks of at least 3000 Hz. And further preferably, all the resonance peaks may be within the frequency range of 200 Hz-12000 Hz, and there may be at least two resonance peaks with a difference of the frequency values between the two resonance peaks of at least 4000 Hz. All the resonance peaks may be within the frequency range of 500 Hz-10000 Hz, and there may be at least two resonance peaks with a difference of the frequency values between the two resonance peaks of at least 400 Hz. Preferably, all the resonance peaks may be within the frequency range of 500 Hz-10000 Hz, and there may be at least two resonance peaks with a difference of the frequency values between the two resonance peaks of at least 1000 Hz. More preferably, all the resonance peaks may be within the frequency range of 500 Hz-10000 Hz, and there may be at least two resonance peaks with a difference of the frequency values between the two resonance peaks of at least 2000 Hz. More preferably, all the resonance peaks may be within the frequency range of 500 Hz-10000 Hz, and there may be at least two resonance peaks with a difference of the frequency values between the two resonance peaks of at least 3000 Hz. Moreover, further preferably, all the resonance peaks may be within the frequency range of 500 Hz-10000 Hz, and there may be at least two resonance peaks with a difference of the frequency values between the two resonance peaks of at least 4000 Hz. In one embodiment, the compound vibration system including the vibration board, the first vibration conductive plate, and the second vibration conductive plate may generate a frequency response as shown in FIG. 8-B. The compound vibration system with the first vibration conductive plate may generate three obvious resonance peaks, which may improve the sensitivity of the frequency response in the low-frequency range (about 600 Hz), obtain a smoother frequency response, and improve the sound quality.

The resonance peak may be shifted by changing a parameter of the first vibration conductive plate, such as the size and material, so as to obtain an ideal frequency response eventually. For example, the stiffness coefficient of the first vibration conductive plate may be reduced to a designed value, causing the resonance peak to move to a designed low frequency, thus enhancing the sensitivity of the bone conduction speaker in the low frequency, and improving the quality of the sound. As shown in FIG. 8-C, as the stiffness coefficient of the first vibration conductive plate decreases (i.e., the first vibration conductive plate becomes softer), the resonance peak moves to the low frequency region, and the sensitivity of the frequency response of the bone conduction speaker in the low frequency region gets improved. Preferably, the first vibration conductive plate may be an elastic plate, and the elasticity may be determined based on the material, thickness, structure, or the like. The material of the first vibration conductive plate may include but not limited to steel (for example but not limited to, stainless steel, carbon steel, etc.), light alloy (for example but not limited to, aluminum, beryllium copper, magnesium alloy, titanium alloy, etc.), plastic (for example but not limited to, polyethylene, nylon blow molding, plastic, etc.). It may be a single material or a composite material that achieve the same performance. The composite material may include but not limited to reinforced material, such as glass fiber, carbon fiber, boron fiber, graphite fiber, graphene fiber, silicon carbide fiber, aramid fiber, or the like. The composite material may also be other organic and/or inorganic composite materials, such as various types of glass fiber reinforced by unsaturated polyester and epoxy, fiberglass comprising phenolic resin matrix. The thickness of the first vibration conductive plate may be not less than 0.005 mm. Preferably, the thickness may be 0.005 mm-3 mm. More preferably, the thickness may be 0.01 mm-2 mm. More preferably, the thickness may be 0.01 mm-1 mm. Moreover, further preferably, the thickness may be 0.02 mm-0.5 mm. The first vibration conductive plate may have an annular structure, preferably including at least one annular ring, preferably, including at least two annular rings. The annular ring may be a concentric ring or a non-concentric ring and may be connected to each other via at least two rods converging from the outer ring to the center of the inner ring. More preferably, there may be at least one oval ring. More preferably, there may be at least two oval rings. Different oval rings may have different curvatures radiuses, and the oval rings may be connected to each other via rods. Further preferably, there may be at least one square ring. The first vibration conductive plate may also have the shape of a plate. Preferably, a hollow pattern may be configured on the plate. Moreover, more preferably, the area of the hollow pattern may be not less than the area of the non-hollow portion. It should be noted that the above-described material, structure, or thickness may be combined in any manner to obtain different vibration conductive plates. For example, the annular vibration conductive plate may have a different thickness distribution. Preferably, the thickness of the ring may be equal to the thickness of the rod. Further preferably, the thickness of the rod may be larger than the thickness of the ring. Moreover, still, further preferably, the thickness of the inner ring may be larger than the thickness of the outer ring.

When the compound vibration device is applied to the bone conduction speaker, the major applicable area is bone conduction earphones. Thus the bone conduction speaker adopting the structure will be fallen into the protection of the present disclosure.

The bone conduction speaker and its compound vibration device stated in the present disclosure, make the technique simpler with a lower cost. Because the two parts in the compound vibration device can adjust the low frequency as well as the high frequency ranges, as shown in FIG. 5, which makes the achieved frequency response flatter, and voice more broader, avoiding the problem of abrupt frequency response and feeble voices caused by single vibration device, thus broaden the application prospection of bone conduction speaker.

Figure 4:
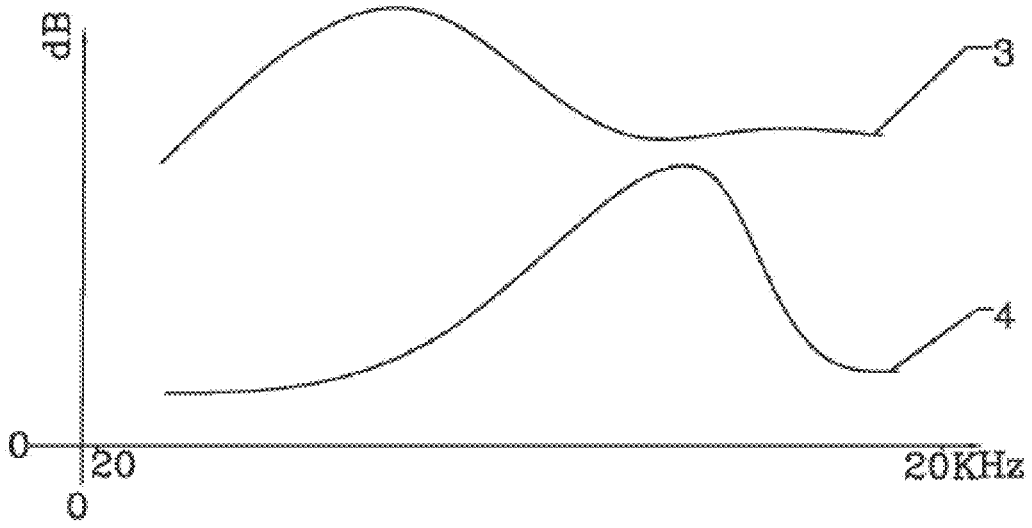
FIG. 4 illustrates a frequency response curves of the bone conduction speakers of vibration device in the prior art.

In the prior art, the vibration parts did not take full account of the effects of every part to the frequency response, thus, although they could have the similar outlooks with the products described in the present disclosure, they will generate an abrupt frequency response, or feeble sound. And due to the improper matching between different parts, the resonance peak could have exceeded the human hearable range, which is between 20 Hz and 20 KHz. Thus, only one sharp resonance peak as shown in FIG. 4 appears, which means a pretty poor tone quality.

It should be made clear that, the above detailed description of the better implement examples should not be considered as the limitations to the present disclosure protections. The extent of the patent protection of the present disclosure should be determined by the terms of claims.

EXAMPLES

Example 1

A bone conduction speaker may include a U-shaped headset bracket/headset lanyard, two vibration units, a transducer connected to each vibration unit. The vibration unit may include a contact surface and a housing. The contact surface may be an outer surface of a silicone rubber transfer layer and may be configured to have a gradient structure including a convex portion. A clamping force between the contact surface and skin due to the headset bracket/headset lanyard may be unevenly distributed on the contact surface. The sound transfer efficiency of the portion of the gradient structure may be different from the portion without the gradient structure.

Example 2

This example may be different from Example 1 in the following aspects. The headset bracket/headset lanyard as described may include a memory alloy. The headset bracket/headset lanyard may match the curves of different users' heads and have a good elasticity and a better wearing comfort. The headset bracket/headset lanyard may recover to its original shape from a deformed status last for a certain period. As used herein, the certain period may refer to ten minutes, thirty minutes, one hour, two hours, five hours, or may also refer to one day, two days, ten days, one month, one year, or a longer period. The clamping force that the headset bracket/headset lanyard provides may keep stable, and may not decline gradually over time. The force intensity between the bone conduction speaker and the body surface of a user may be within an appropriate range, so as to avoid pain or clear vibration sense caused by undue force when the user wears the bone conduction speaker. Moreover, the clamping force of bone conduction speaker may be within a range of 0.2N~1.5N when the bone conduction speaker is used.

Example 3

The difference between this example and the two examples mentioned above may include the following aspects. The elastic coefficient of the headset bracket/headset lanyard may be kept in a specific range, which results in the value of the frequency response curve in low frequency (e.g., under 500 Hz) being higher than the value of the frequency response curve in high frequency (e.g., above 4000 Hz).

Example 4

The difference between Example 4 and Example 1 may include the following aspects. The bone conduction speaker may be mounted on an eyeglass frame, or in a helmet or mask with a special function.

Example 5

The difference between this example and Example 1 may include the following aspects. The vibration unit may include two or more panels, and the different panels or the vibration transfer layers connected to the different panels may have different gradient structures on a contact surface being in contact with a user. For example, one contact surface may have a convex portion, the other one may have a concave structure, or the gradient structures on both the two contact surfaces may be convex portions or concave structures, but there may be at least one difference between the shape or the number of the convex portions.

Example 6

A portable bone conduction hearing aid may include multiple frequency response curves. A user or a tester may choose a proper response curve for hearing compensation according to an actual response curve of the auditory system of a person. In addition, according to an actual requirement, a vibration unit in the bone conduction hearing aid may enable the bone conduction hearing aid to generate an ideal frequency response in a specific frequency range, such as 500 Hz-4000 Hz.

Example 7

A vibration generation portion of a bone conduction speaker may be shown in FIG. 9-A. A transducer of the bone conduction speaker may include a magnetic circuit system including a magnetic flux conduction plate 910, a magnet 911 and a magnetizer 912, a vibration board 914, a coil 915, a first vibration conductive plate 916, and a second vibration conductive plate 917. The panel 913 may protrude out of the housing 919 and may be connected to the vibration board 914 by glue. The transducer may be fixed to the housing 919 via the first vibration conductive plate 916 forming a suspended structure.

A compound vibration system including the vibration board 914, the first vibration conductive plate 916, and the second vibration conductive plate 917 may generate a smoother frequency response curve, so as to improve the sound quality of the bone conduction speaker. The transducer may be fixed to the housing 919 via the first vibration conductive plate 916 to reduce the vibration that the transducer is transferring to the housing, thus effectively decreasing sound leakage caused by the vibration of the housing, and reducing the effect of the vibration of the housing on the sound quality. FIG. 9-B shows frequency response curves of the vibration intensities of the housing of the vibration generation portion and the panel. The bold line refers to the frequency response of the vibration generation portion including the first vibration conductive plate 916, and the thin line refers to the frequency response of the vibration generation portion without the first vibration conductive plate 916. As shown in FIG. 9-B, the vibration intensity of the housing of the bone conduction speaker without the first vibration conductive plate may be larger than that of the bone conduction speaker with the first vibration conductive plate when the frequency is higher than 500 Hz. FIG. 9-C shows a comparison of the sound leakage between a bone conduction speaker includes the first vibration conductive plate 916 and another bone conduction speaker does not include the first vibration conductive plate 916. The sound leakage when the bone conduction speaker includes the first vibration conductive plate may be smaller than the sound leakage when the bone conduction speaker does not include the first vibration conductive plate in the intermediate frequency range (for example, about 1000 Hz). It can be concluded that the use of the first vibration conductive plate between the panel and the housing may effectively reduce the vibration of the housing, thereby reducing the sound leakage.

The first vibration conductive plate may be made of the material, for example but not limited to stainless steel, copper, plastic, polycarbonate, or the like, and the thickness may be in a range of 0.01 mm-1 mm.

Example 8

Figure 10:
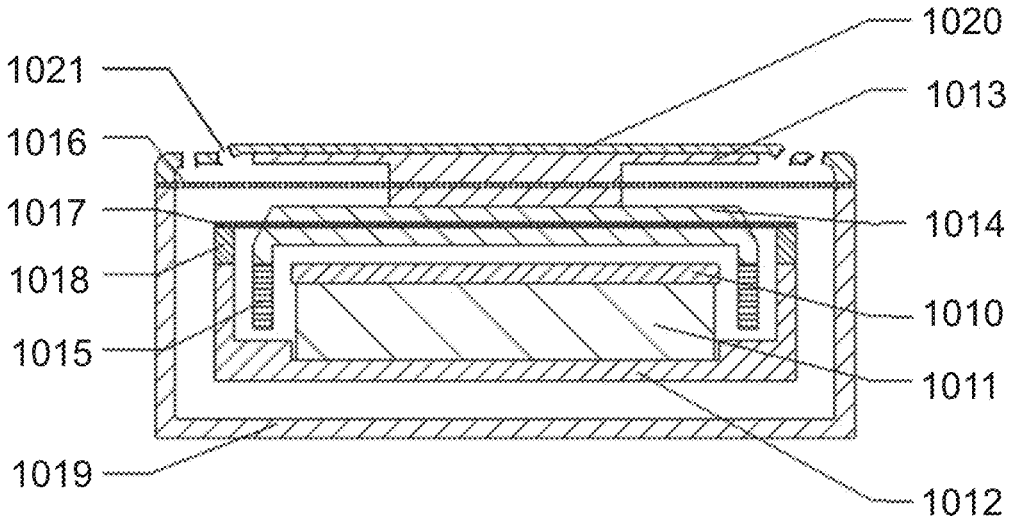
FIG. 10 illustrates a structure of the vibration generation portion of the bone conduction speaker according to one specific embodiment of the present disclosure.

This example may be different with Example 7 in the following aspects. As shown in FIG. 10, the panel 1013 may be configured to have a vibration transfer layer 1020 (for example but not limited to, silicone rubber) to produce a certain deformation to match a user's skin. A contact portion being in contact with the panel 1013 on the vibration transfer layer 1020 may be higher than a portion not being in contact with the panel 1013 on the vibration transfer layer 1020 to form a step structure. The portion not being in contact with the panel 1013 on the vibration transfer layer 1020 may be configured to have one or more holes 1021. The holes on the vibration transfer layer may reduce the sound leakage: the connection between the panel 1013 and the housing 1019 via the vibration transfer layer 1020 may be weakened, and vibration transferred from panel 1013 to the housing 1019 via the vibration transfer layer 1020 may be reduced, thereby reducing the sound leakage caused by the vibration of the housing; the area of the vibration transfer layer 1020 configured to have holes on the portion without protrusion may be reduced, thereby reducing air and sound leakage caused by the vibration of the air; the vibration of air in the housing may be guided out, interfering with the vibration of air caused by the housing 1019, thereby reducing the sound leakage.

Example 9

The difference between this example and Example 7 may include the following aspects. As the panel may protrude out of the housing, meanwhile, the panel may be connected to the housing via the first vibration conductive plate, the degree of coupling between the panel and the housing may be dramatically reduced, and the panel may be in contact with a user with a higher freedom to adapt complex contact surfaces (as shown in the right figure of FIG. 11-A) as the first vibration conductive plate provides a certain amount of deformation. The first vibration conductive plate may incline the panel relative to the housing with a certain angle. Preferably, the slope angle may not exceed 5 degrees.

The vibration efficiency may differ with contacting statuses. A better contacting status may lead to a higher vibration transfer efficiency. As shown in FIG. 11-B, the bold line shows the vibration transfer efficiency with a better contacting status, and the thin line shows a worse contacting status. It may be concluded that the better contacting status may correspond to a higher vibration transfer efficiency.

Example 10

Figure 12:
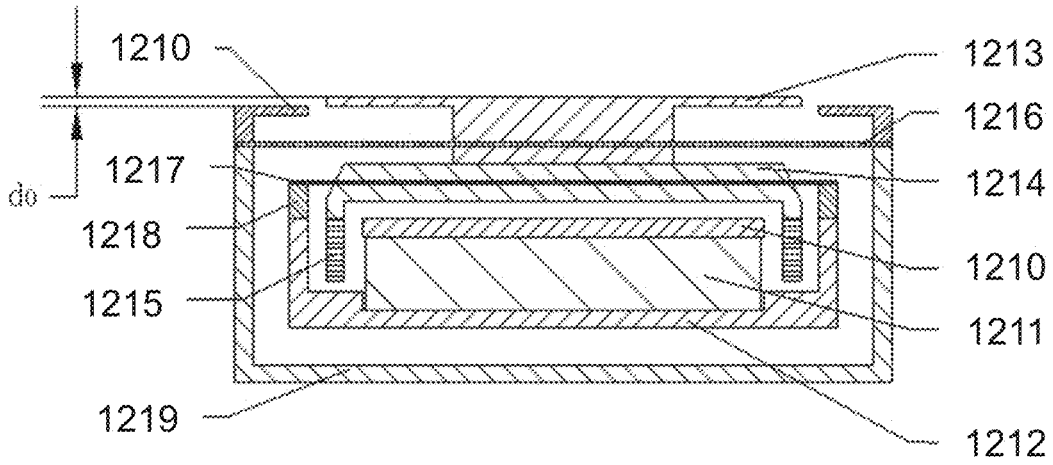
FIG. 12 illustrates a structure of the vibration generation portion of the bone conduction speaker according to one specific embodiment of the present disclosure.

The difference between this example and Example 7 may include the following aspects. A boarder may be added to surround the housing. When the housing contact with a user's skin, the surrounding boarder may facilitate an even distribution of an applied force, and improve the user's wearing comfort. As shown in FIG. 12, there may be a height difference do between the surrounding border 1210 and the panel 1213. The force from the skin to the panel 1213 may decrease the distanced between the panel 1213 and the surrounding border 1210. When the force between the bone conduction speaker and the user is larger than the force applied to the first vibration conductive plate with a deformation of do, the extra force may be transferred to the user's skin via the surrounding border 1210, without influencing the clamping force of the vibration portion, with the consistency of the clamping force improved, thereby ensuring the sound quality.

Example 11

Figure 13:
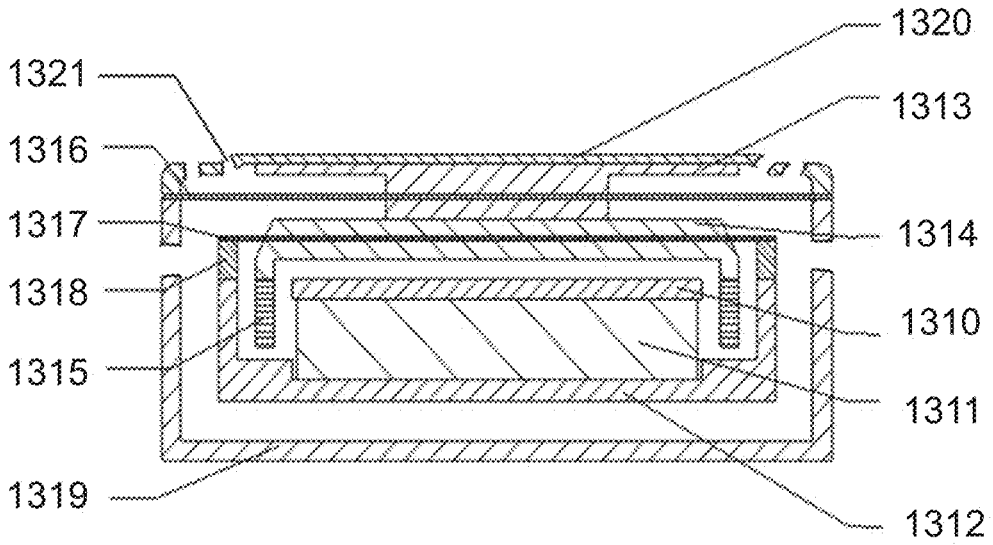
FIG. 13 illustrates a structure of the vibration generation portion of the bone conduction speaker according to one specific embodiment of the present disclosure.

The difference between this example and Example 8 may include the following aspects. As shown in FIG. 13, sound guiding holes are located at the vibration transfer layer 1320 and the housing 1319, respectively. The acoustic wave formed by the vibration of the air in the housing is guided to the outside of the housing, and interferes with the leaked acoustic wave due to the vibration of the air out of the housing, thus reducing the sound leakage.

It should be noted that the bone conduction speakers described above are only for illustration purposes, other acoustic output apparatus may have different structures. For example, an acoustic output apparatus may include an acoustic driver (also referred to as a vibration device). The an acoustic driver may output sound through one or more sound guiding holes set on the acoustic output apparatus. In some embodiments, the acoustic driver may include a low-frequency acoustic driver that outputs sound from at least two first sound guiding holes and a high-frequency acoustic driver that outputs sound from at least two second sound guiding holes. In some embodiments, the low-frequency acoustic driver and/or the high-frequency acoustic driver may be implemented by a vibration device (or a compound vibration device) described elsewhere in the present disclosure. In some embodiments, the acoustic output apparatus may also include an interactive control component configured to allow an interaction between a user and the acoustic output apparatus.

Figure 14:
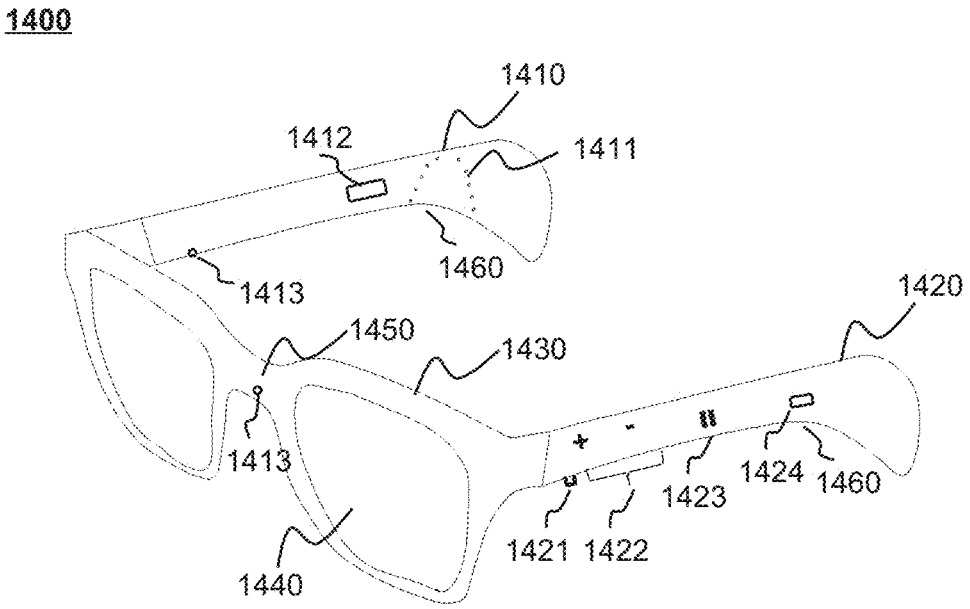
FIG. 14 is a schematic diagram illustrating an exemplary acoustic output apparatus embodied as a glasses according to some embodiments of the present disclosure.

FIG. 14 is a schematic diagram illustrating an exemplary acoustic output apparatus embodied as glasses according to some embodiments of the present disclosure. As shown in FIG. 14, the glasses 1400 may include a frame and lenses 1440. The frame may include legs 1410 and 1420, a lens ring 1430, a nose pad 1450, or the like. The legs 1410 and 1420 may be used to support the lens ring 1430 and the lenses 1440, and fix the glasses 1400 on the user's face. The lens ring 1430 may be used to support the lenses 1440. The nose pad 1450 may be used to fix the glasses 1400 on the user's nose.

The glasses 1400 may be provided with a plurality of components which may implement different functions. Exemplary components may include a power source assembly for providing power, an acoustic driver for generating sound, a microphone for detecting external sound, a bluetooth module for connecting the glasses 1400 to other devices, a controller for controlling the operation of other components, or the like, or any combination thereof. In some embodiments, the interior of the leg 1410 and/or the leg 1420 may be provided as a hollow structure for accommodating the one or more components.

The glasses 1400 may be provided with a plurality of hollow structures. For example, as shown in FIG. 14, a side of the leg 1410 and/or the leg 1420 facing away from the user's face may be provided with sound guiding holes 1411. The sound guiding holes 1411 may be connected to one or more acoustic drivers that are set inside of the glasses 1400 to export sound produced by the one or more the acoustic drivers. In some embodiments, the sound guiding holes 1411 may be provided at a position near the user's ear on the leg 1410 and/or the leg 1420. For example, the sound guiding holes 1411 may be provided at a rear end of the leg 1410 and/or the leg 1420 being far away from the lens ring 1430, a bending part 1460 of the leg, or the like. As another example, the glasses 1400 may also have a power interface 1412, which may be used to charge the power source assembly in the glasses 1400. The power interface 1412 may be provided on a side of the leg 1410 and/or the leg 1420 facing the user's face. Exemplary power interfaces may include a dock charging interface, a DC charging interface, a USB charging interface, a lightning charging interface, a wireless charging interface, a magnetic charging interface, or the like, or any combination thereof. In some embodiments, one or more sound inlet holes 1413 may also be provided on the glasses 1400, and may be used to transmit external sounds (for example, a user's voice, ambient sound, etc.) to the microphones in the glasses 1400. The sound inlet holes 1413 may be provided at a position facilitating an acquisition of the user's voice on the glasses 1400, for example, a position near the user's mouth on the leg 1410 and/or 1420, a position near the user's mouth under the lens ring 1430, a position on the nose pad 1450, or any combination thereof. In some embodiments, shapes, sizes, and counts of the one or more hollow structures on the glasses 1400 may vary according to actual needs. For example, the shapes of the hollow structures may include, but not limited to, a square shape, a rectangle shape, a triangle shape, a polygon shape, a circle shape, an ellipse shape, an irregular shape, or the like.

In some embodiments, the glasses 1400 may be further provided with one or more button structures, which may be used to implement interact ions between the user and the glasses 1400. As shown in FIG. 14, the one or more button structures may include a power button 1421, a sound adjustment button 1422, a playback control button 1423, a bluetooth button 1424, or the like. The power button 1421 may include a power on button, a power off button, a power hibernation button, or the like, or any combination thereof. The sound adjustment button 1422 may include a sound increase button, a sound decrease button, or the like, or any combination thereof. The playback control button 1423 may include a playback button, a pause button, a resume playback button, a call playback button, a call drop button, a call hold button, or the like, or any combination thereof. The bluetooth button 1424 may include a bluetooth connection button, a bluetooth off button, a selection button, or the like, or any combination thereof. In some embodiments, the button structures may be provided on the glasses 1400. For example, the power button may be provided on the leg 1410, the leg 1420, or the lens ring 1430. In some embodiments, the one or more button structures may be provided in one or more control devices. The glasses 1400 may be connected to the one or more control devices via a wired or wireless connection. The control devices may transmit instructions input by the user to the glasses 1400, so as to control the operations of the one or more components in the glasses 1400.

In some embodiments, the glasses 1400 may also include one or more indicators to indicate information of one or more components in the glasses 1400. For example, the indicators may be used to indicate a power status, a bluetooth connection status, a playback status, or the like, or any combination thereof. In some embodiments, the indicators may indicate related information of the components via different indicating conditions (for example, different colors, different time, etc.). Merely by way of example, when a power indicator is red, it is indicated that the power source assembly may be in a state of low power. When the power indicator is green, indicating that the power source assembly may be a state of full power. As another example, a bluetooth indicator may flash intermittently, indicating that the bluetooth is connecting to another device. The bluetooth indicator may be blue, indicating that the bluetooth may be connected successfully.

In some embodiments, a sheath may be provided on the leg 1410 and/or the leg 1420. The sheath may be made of soft material with a certain elasticity, such as silicone, rubber, etc., so as to provide a better sense of touch for the user.

In some embodiments, the frame may be formed integrally, or assembled by plugging, inserting, or the like. In some embodiments, materials used to manufacture the frame may include but not limited to, steel, alloy, plastic, or other single or composite materials. The steel may include but not limited to, stainless steel, carbon steel, or the like. The alloy may include but is not limited to, aluminum alloy, chromium-molybdenum steel, rhenium alloy, magnesium alloy, titanium alloy, magnesium-lithium alloy, nickel alloy, or the like. The plastic may include but not limited to, acrylonitrile-butadiene-styrene copolymer (Acrylonitrile butadiene styrene, ABS), polystyrene (PS), high impact polystyrene (HIPS), polypropylene (PP), polyethylene terephthalate (PET), polyester (PES), polycarbonate (PC), polyamide (PA), polyvinyl chloride (PVC), polyethylene and blown nylon, or the like. The single or composite materials may include but not limited to, glass fiber, carbon fiber, boron fiber, graphite fiber, graphene fiber, silicon carbide fiber, aramid fiber and other reinforcing materials; or a composite of other organic and/or inorganic materials, such as glass fiber reinforced unsaturated polyester, various types of glass steel with epoxy resin or phenolic resin, etc.

The description of the glasses 1400 may be provided for illustration purposes and not intended to limit the scope of the present disclosure. For those skilled in the art, various changes and modifications may be made according to the description of the present disclosure. For example, the glasses 1400 may include one or more cameras to capture environmental information (for example, scenes in front of the user). As another example, the glasses 1400 may also include one or more projectors for projecting pictures (for example, pictures that users see through the glasses 1400) onto a display screen.

Figure 15:
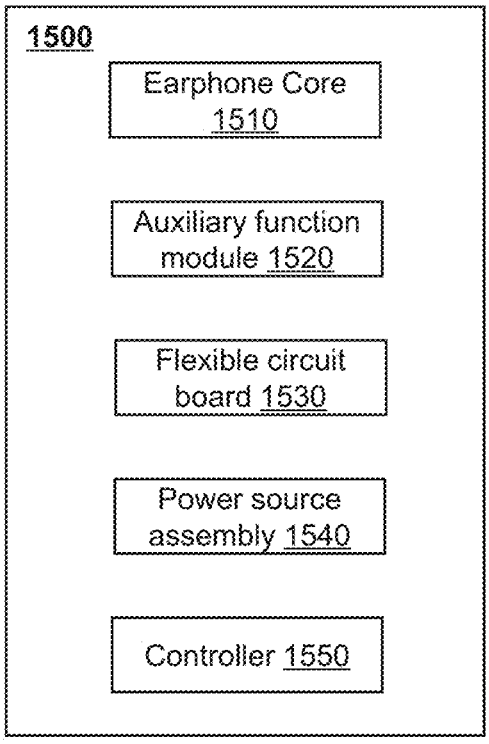
FIG. 15 is a schematic diagram illustrating exemplary components in an acoustic output apparatus according to some embodiments of the present disclosure.

FIG. 15 is a schematic diagram illustrating components in an acoustic output apparatus (e.g., the glasses 1400). As shown in FIG. 15, the acoustic output apparatus 200 may include one or more of an earphone core 1510, an auxiliary function module 1520, a flexible circuit board 1530, a power source assembly 1540, a controller 1550, or the like.

The earphone core 1510 may be configured to process signals containing audio information, and convert the signals into sound signals. The audio information may include video or audio files with a specific data format, or data or files that may be converted into sound in a specific manner. The signals containing the audio information may include electrical signals, optical signals, magnetic signals, mechanical signals or the like, or any combination thereof. The processing operation may include frequency division, filtering, denoising, amplification, smoothing, or the like, or any combination thereof. The conversion may involve a coexistence and interconversion of energy of different types. For example, the electrical signal may be converted into mechanical vibrations that generates sound through the earphone core 1510 directly. As another example, the audio information may be included in the optical signal, and a specific earphone core may implement a process of converting the optical signal into a vibration signal. Energy of other types that may coexist and interconvert to each other during the working process of the earphone core 1510 may include thermal energy, magnetic field energy, and so on.

In some embodiments, the earphone core 1510 may include one or more acoustic drivers. The acoustic driver(s) may be used to convert electrical signals into sound for playback.

The auxiliary function module 1520 may be configured to receive auxiliary signals and execute auxiliary functions. The auxiliary function module 1520 may include one or more microphones, key switches, bluetooth modules, sensors, or the like, or any combination thereof. The auxiliary signals may include status signals (for example, on, off, hibernation, connection, etc.) of the auxiliary function module 1520, signals generated through user operations (for example, input and output signals generated by the user through keys, voice input, etc.), signals in the environment (for example, audio signals in the environment), or the like, or any combination thereof. In some embodiments, the auxiliary function module 1520 may transmit the received auxiliary signals through the flexible circuit board 1530 to the other components in the acoustic output apparatus 1500 for processing.

A button module may be configured to control the acoustic output apparatus 1500, so as to implement the interaction between the user and the acoustic output apparatus 1500. The user may send a command to the acoustic output apparatus 1500 through the button module to control the operation of the acoustic output apparatus 1500. In some embodiments, the button module may include a power button, a playback control button, a sound adjustment button, a telephone control button, a recording button, a noise reduction button, a bluetooth button, a return button, or the like, or any combination thereof. The power button may be configured to control the status (on, off, hibernation, or the like) of the power source assembly module. The playback control button may be configured to control sound playback by the earphone core 1510, for example, playing information, pausing information, continuing to play information, playing a previous item, playing a next item, mode selection (e.g. a sport mode, a working mode, an entertainment mode, a stereo mode, a folk mode, a rock mode, a bass mode, etc.), playing environment selection (e.g., indoor, outdoor, etc.), or the like, or any combination thereof. The sound adjustment button may be configured to control a sound amplitude of the earphone core 1510, for example, increasing the sound, decreasing the sound, or the like. The telephone control button may be configured to control telephone answering, rejection, hanging up, dialing back, holding, and/or recording incoming calls. The record button may be configured to record and store the audio information. The noise reduction button may be configured to select a degree of noise reduction. For example, the user may select a level or degree of noise reduction manually, or the acoustic output apparatus 1500 may select a level or degree of noise reduction automatically according to a playback mode selected by the user or detected ambient sound. The bluetooth button may be configured to turn on bluetooth, turn off bluetooth, match bluetooth, connect bluetooth, or the like, or any combination thereof. The return button may be configured to return to a previous menu, interface, or the like.

A sensor may be configured to detect information related to the acoustic output apparatus 1500. For example, the sensor may be configured to detect the user's fingerprint, and transmit the detected fingerprint to the controller 1550. The controller 1550 may match the received fingerprint with a fingerprint pre-stored in the acoustic output apparatus 1500. If the matching is successful, the controller 1550 may generate an instruction that may be transmitted to each component to initiate the sound output apparatus 1500. As another example, the sensor may be configured to detect the position of the acoustic output apparatus 1500. When the sensor detects that the acoustic output apparatus 1500 is detached from a user's face, the sensor may transmit the detected information to the controller 1550, and the controller 1550 may generate an instruction to pause or stop the playback of the acoustic output apparatus 1500. In some embodiments, exemplary sensors may include a ranging sensor (e.g., an infrared ranging sensor, a laser ranging sensor, etc.), a speed sensor, a gyroscope, an accelerometer, a positioning sensor, a displacement sensor, a pressure sensor, a gas sensor, a light sensor, a temperature sensor, a humidity sensor, a fingerprint sensor, an image sensor, an iris sensor, an image sensor (e.g., a vidicon, a camera, etc.), or the like, or any combination thereof.

The flexible circuit board 1530 may be configured to connect different components in the acoustic output apparatus 1500. The flexible circuit board 1530 may be a flexible printed circuit (FPC). In some embodiments, the flexible circuit board 1530 may include one or more bonding pads and/or one or more flexible wires. The one or more bonding pads may be configured to connect the one or more components of the acoustic output apparatus 1500 or other bonding pads. One or more leads may be configured to connect the components of the acoustic output apparatus 1500 with one bonding pad, two or more bonding pads, or the like. In some embodiments, the flexible circuit board 1530 may include one or more flexible circuit boards. Merely by ways of example, the flexible circuit board 1530 may include a first flexible circuit board and a second flexible circuit board. The first flexible circuit board may be configured to connect two or more of the microphone, the earphone core 1510, and the controller 1550. The second flexible circuit board may be configured to connect two or more of the power source assembly 1540, the earphone core 1510, the controller 1550, or the like. In some embodiments, the flexible circuit board 1530 may be an integral structure including one or more regions. For example, the flexible circuit board 1530 may include a first region and a second region. The first region may be provided with flexible leads for connecting the bonding pads on the flexible circuit board 1530 and other components on the acoustic output apparatus 1500. The second region may be configured to set one or more bonding pads. In some embodiments, the power source assembly 1540 and/or the auxiliary function module 1520 may be connected to the flexible circuit board 1530 (for example, the bonding pads) through the flexible leads of the flexible circuit board 1530.

The power source assembly 1540 may be configured to provide electrical power to the components of the acoustic output apparatus 1500. In some embodiments, the power source assembly 1540 may include a flexible circuit board, a battery, etc. The flexible circuit board may be configured to connect the battery and other components of the acoustic output apparatus 1500 (for example, the earphone core 1510), and provide power for operations of the other components. In some embodiments, the power source assembly 1540 may also transmit its state information to the controller 1550 and receive instructions from the controller 1550 to perform corresponding operations. The state information of the power source assembly 1540 may include an on/off state, state of charge, time for use, a charging time, or the like, or any combination thereof. In some embodiments, the power source assembly may include a body region and a sealing region. The thickness of the body region may be greater than the thickness of the sealing region. A side surface of the sealing region and a side surface of the body region may have a shape of a stair.

According to information of the one or more components of the acoustic output apparatus 1500, the controller 1550 may generate an instruction to control the power source assembly 1540. For example, the controller 1550 may generate control instructions to control the power source assembly 1540 to provide power to the earphone core 1510 for generating sound. As another example, when the acoustic output apparatus 1500 does not receive input information within a certain time, the controller 1550 may generate a control instruction to control the power source assembly 1540 to enter a hibernation state. In some embodiments, the power source assembly 1540 may include a storage battery, a dry battery, a lithium battery, a Daniel battery, a fuel battery, or any combination thereof.

Merely by way of example, the controller 1550 may receive a sound signal from the user, for example, "play a song", from the auxiliary function module 1520. By processing the sound signal, the controller 1550 may generate control instructions related to the sound signal. For example, the control instructions may control the earphone core 1510 to obtain information of songs from the storage module (or other devices). Then an electric signal for controlling the vibration of the earphone core 1510 may be generated according to the information.

In some embodiments, the controller 1550 may include one or more electronic frequency division modules. The electronic frequency division modules may divide a frequency of a source signal. The source signal may come from one or more sound source apparatus (for example, a memory storing audio data) integrated in the acoustic output apparatus. The source signal may also be an audio signal (for example, an audio signal received from the auxiliary function module 1520) received by the acoustic output apparatus 1500 in a wired or wireless manner. In some embodiments, the electronic frequency division modules may decompose an input source signal into two or more frequency-divided signals containing different frequencies. For example, the electronic frequency division module may decompose the source signal into a first frequency-divided signal with high-frequency sound and a second frequency-divided signal with low-frequency sound. Signals processed by the electronic frequency division modules may be transmitted to the acoustic driver in the earphone core 1510 in a wired or wireless manner.

In some embodiments, the controller 1550 may include a central processing unit (CPU), an application-specific integrated circuit (ASIC), an application-specific instruction-set processor (ASIP), a graphics processing unit (GPU), a physical processing unit (PPU), a digital signal processor (DSP), a field-programmable gate array (FPGA), a programmable logic device (PLD), a controller, a microcontroller unit, a reduced instruction set computer (RISC), a microprocessor, or the like, or any combination thereof.

In some embodiments, one or more of the earphone core 1510, the auxiliary function module 1520, the flexible circuit board 1530, the power source assembly 1530, and the controller 1550 may be provided in the frame of the glasses 1400. Specifically, one or more of the electronic components may be provided in the hollow structure of the leg 1410 and/or the leg 1420. The connection and/or communication between the electronic components provided in the leg 1410 and/or the leg 1420 may be wired or wireless. The wired connection may include metal cables, fiber optical cables, hybrid cables, or the like, or any combination thereof. The wireless connection may include a local area network (LAN), a wide area network (WAN), a bluetooth, a ZigBee, a near field communication (NFC), or the like, or any combination thereof.

The description of the acoustic output apparatus 1500 may be for illustration purposes, and not intended to limit the scope of the present disclosure. For those skilled in the art, various changes and modifications may be made according to the description of the present disclosure. For example, the components and/or functions of the acoustic output apparatus 1500 may be changed or modified according to a specific implementation. For example, the acoustic output apparatus 1500 may include a storage component for storing signals containing audio information. As another example, the acoustic output apparatus 1500 may include one or more processors, which may execute one or more sound signal processing algorithms for processing sound signals. These changes and modifications may remain within the scope of the present disclosure.

Figure 16:
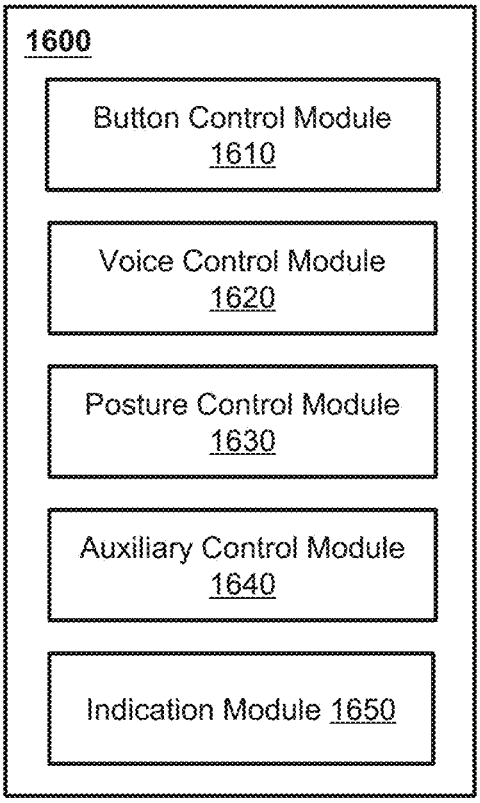
FIG. 16 is a block diagram illustrating an exemplary interactive control component in an acoustic output apparatus according to some embodiments of the present disclosure.

FIG. 16 is a block diagram illustrating an exemplary interactive control system in an acoustic output apparatus according to some embodiments of the present disclosure. In some embodiments, at least part of functions of the interactive control component 1600 may be implemented by the auxiliary function module 1520 illustrated in FIG. 15. For example, modules and/or units in the interactive control component 1600 may be integrated in the auxiliary function module 1520 as part thereof. In some embodiments, the interactive control component 1600 may be disposed as an independent system in the acoustic output apparatus for interactive control (e.g., interactive control in an AR/VR scenario). In some embodiments, the interactive control component 1600 may include a button control module 1610, a voice control module 1620, a posture control module 1630, an auxiliary control module 1640, and an indication control module 1650.

The button control module 1610 may be configured to control the acoustic output apparatus, so as to implement an interaction between a user and the acoustic output apparatus. The user may send an instruction to the acoustic output apparatus through the button control module 1610 to control an operation of the acoustic output apparatus. In some embodiments, the button control module 1610 may include a power button, a playback control button, a sound adjustment button, a telephone control button, a recording button, a noise reduction button, a bluetooth button, a return button, or the like, or any combination thereof. Functions of one or more buttons included in the button control module 1610 may be similar to the button module of the auxiliary function module 1520 illustrated in FIG. 15, and may not be repeated here. In some embodiments, the one or more buttons included in the button control module 1610 may be disposed on the glasses 1400. For example, the power button may be disposed on the leg 1410, the leg 1420, or the lens ring 1430. In some embodiments, the one or more buttons included in the button control module 1610 may be disposed in one or more control devices. The glasses 1400 may be connected to the one or more control devices via a wired or wireless connection. The control devices may transmit instructions input by the user to the glasses 1400, so as to control operations of the one or more components in the glasses 1400.

In some embodiments, the button control module 1610 may include two forms including physical buttons and virtual buttons. For example, when the button control module 1610 includes physical buttons, the physical buttons may be disposed outside a housing of an acoustic output apparatus (e.g., the glasses 1400). When the user wears the acoustic output apparatus, the physical buttons may not contact with human skin and may be exposed on the outside to facilitate user operations on the physical button. In some embodiments, an end surface of each button in the button control module 1610 may be provided with an identifier corresponding to its function. In some embodiments, the identifier may include text (e.g., Chinese and/or English), symbols (e.g., the volume plus button may be marked with "+", and the volume minus button may be marked with "−"), or the like, or any combination thereof. In some embodiments, the identifier may be set on the button by means of laser printing, screen printing, pad printing, laser filler, thermal sublimation, hollow text, or the like, or any combination thereof. In some embodiments, the identifier on the button may also be disposed on the surface of the housing around the buttons. In some embodiments, control programs installed in the acoustic output apparatus may generate virtual buttons on a touch screen having an interaction function. The user may select the function, volume, file, etc. of the acoustic output apparatus through the virtual button. In addition, the acoustic output apparatus may have a combination of a touch screen and a physical button. In some embodiments, the touch screen may be or include a virtual user-interface (UI). Taking an acoustic output apparatus customized for AR as an example, the user may interact with the acoustic output apparatus via the virtual UI. One or more virtual buttons may be provided on the virtual UI. The user may select and/or touch the one or more virtual buttons to control the acoustic output apparatus. For example, the user may select a virtual sound adjustment button on the virtual UI to adjust a volume of an audio played in the virtual UI. Alternatively or additionally, the user may also adjust the volume of the audio played in the virtual UI by selecting one or more physical buttons disposed on the acoustic output apparatus.

In some embodiments, the button control module 1610 may implement different interaction functions based on different operations of the user. For example, the user may click a button (a physical button or a virtual button) once to pause or start a music, a recording, etc. As another example, the user may tap the button twice quickly to answer a call. As a further example, the user may click the button regularly (e.g., clicking once every second for a total of two clicks) to start a recording. In some embodiments, the operations of the user may include clicking, swiping, scrolling, or the like, or any combination thereof. For example, the user may slide up and down on a surface of a button using his/her finger to increase or decrease volume.

In some embodiments, the functions corresponding to the button control module 1610 may be customized by the user. For example, the user may adjust the functions that the button control module 1610 can implement through applications settings. In addition, operation modes (e.g., the number of clicks and swipe gestures) to achieve a specific function may also be set by the user through the application. For example, an operation instruction for answering a call may be set from one click to two clicks, and an operation instruction for switching to the next or the previous song may be set from two clicks to three clicks. According to the above user-defined methods, the operation modes of the button control module 1610 may conform operating habits of the user, which may avoid operating errors and improve user experience.

In some embodiments, the acoustic output apparatus may be connected to an external device through the button control module 1610. For example, the acoustic output apparatus may be connected to a mobile phone through a button configured to control a wireless connection (e.g., a button controlling a Bluetooth module). Optionally, after a connection is established, the user may directly operate the acoustic output apparatus on the external device (e.g., the mobile phone) to implement one or more functions.

Figure 17:
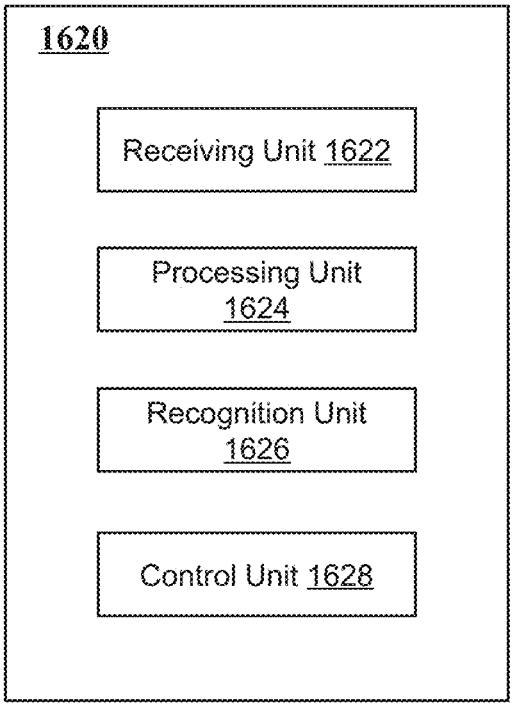
FIG. 17 is a block diagram illustrating an exemplary voice control module in an acoustic output apparatus according to some embodiments of the present disclosure.

The voice control module 1620 may be configured to control the acoustic output apparatus based on voices received from the user. FIG. 17 is a block diagram illustrating an exemplary voice control module in an acoustic output apparatus according to some embodiments of the present disclosure. In some embodiments, as illustrated in FIG. 17, the voice control module 1620 may include a receiving unit 1622, a processing unit 1624, a recognition unit 1626, and a control unit 1628.

The receiving unit 1622 may be configured to receive a voice control instruction from a user (and/or a smart device) and send the voice control instruction to the processing unit 1624. In some embodiments, the receiving unit 1622 may include one or more microphones, or a microphone array. The one or more microphones or the microphone array may be housed within the acoustic output apparatus or in another device connected to the acoustic output apparatus. In some embodiments, the one or more microphones or the microphone array may be generic microphones. In some embodiments, the one or more microphones or the microphone array may be customized for VR and/or AR. In some embodiments, the receiving unit 1622 may be positioned so as to receive audio signals (e.g., speech/voice input by the user to enable a voice control functionality) proximate to the acoustic output apparatus. For example, the receiving unit 1622 may receive a voice control instruction of the user wearing the acoustic output apparatus and/or other users proximate to or interacting with the user. In some embodiments, when the receiving unit 1622 receives a voice control instruction issued by a user, for example, when the receiving unit 1622 receives a voice control instruction of "start playing", the voice control instruction may be sent to the processing unit 1624.

The processing unit 1624 may be communicatively connected with the receiving unit 1622. In some embodiments, when the processing unit 1624 receives a voice control instruction of the user from the receiving unit 1622, the processing unit 1624 may generate an instruction signal based on the voice control instruction, and further send the instruction signal to the recognition unit 1626.

The recognition unit 1626 may be communicatively connected with the processing unit 1624 and the control unit 1628, and configured to identify whether the instruction signal matches a preset signal. The preset signal may be previously input by the user and saved in the acoustic output apparatus (e.g., in a storage module). For example, the recognition unit 1626 may perform a speech recognition process and/or a semantic recognition process on the instruction signal and determine whether the instruction signal matches the preset signal. In response to a determination that the instruction signal matches the preset signal, the recognition unit 1626 may send a matching result to the control unit 1628.

The control unit 1628 may control the operation of the acoustic output apparatus based on the instruction signal and the matching result. Taking an acoustic output apparatus customized for VR as an example, the acoustic output apparatus may be positioned to determine a location of the user wearing the acoustic output apparatus. When the user is proximate to or facing towards a historical site, an audio associated with the historical site may be recommended to the user via a virtual interface. The user may send a voice control instruction of "start playing" for paly the audio. The receiving unit 1622 may receive the voice control instruction and send it to the processing unit 1624. The processing unit 1624 may generate an instruction signal according to the voice control instruction and send the instruction signal to the recognition unit 1626. When the recognition unit 1626 determines that the instruction signal corresponding to the voice control instruction matches a preset signal, the control unit 1628 may execute the voice control instruction automatically. That is, the control unit 1628 may cause the acoustic output apparatus to start playing the audio immediately on the virtual interface.

In some embodiments, the voice control module 1620 may further include a storage module, which may be communicatively connected with the receiving unit 1622, the processing unit 1624, and the recognition unit 1626. The receiving unit 1622 may receive a preset voice control instruction and send it to the processing unit 1624. The processing unit 1624 may generate a preset signal according to a preset voice control instruction and sends the preset signal to the storage module. When the recognition unit 1626 needs to match the instruction signal received by the receiving unit 1622 with the preset signal, the storage module may send the preset signal to the recognition unit 1626 via the communication connection.

In some embodiments, the processing unit 1624 in the voice control module 1620 may further perform a denoise process on the voice control instruction. The denoising process may refer to removing ambient sound included in the voice control instruction. In some embodiments, for example, in a complex environment, the receiving unit 1622 may receive a voice control instruction and send it to the processing unit 1624, before the processing unit 1624 generates a corresponding instruction signal according to the voice control instruction, in order to avoid ambient sounds from disturbing the recognition process of the recognition unit 1626, the voice control instruction may be denoised. For example, when the receiving unit 1622 receives a voice control instruction issued by a user on an outdoor road, the voice control instruction may include noisy environmental sounds such as vehicle driving, whistle on the road. The processing unit 1624 may reduce the influence of the environmental sound on the voice control instruction through the denoise process.

The posture control module 1630 may be configured to control the acoustic output apparatus based on a posture instruction of the user. For example, the posture control module 1630 may recognize an action and/or a posture of the user and perform a function corresponding to the action and/or the posture. In some embodiments, posture control module 1630 may include one or more sensors for recognizing an action and/or a posture of the user. Exemplary sensors may include an optical-based tracking sensor (e.g., an optical camera), an accelerometer, a magnetometer, a gyroscope, a radar, a distance sensor, a speed sensor, a positioning sensor, a displacement sensor, a pressure sensor, a gas sensor, a light sensor, a temperature sensor, a humidity sensor, a fingerprint sensor, an image sensor, an iris sensor, or the like, or any combination thereof. In some embodiments, the one or more sensors may detect a change in the user's orientation, such as a turning of the torso or an about-face movement. In some embodiments, the one or more sensors may sense gestures of the user or a body part (e.g., head, torso, limbs) of the user. In some embodiments, the one or more sensors may generate sensor data regarding the orientation and/or the gestures of the user accordingly and transmit the sensor data to, for example, a processing unit included in the posture control module 1630. The posture control module 1630 may analyze the sensor data and identify an action and/or a posture. Further, the posture control module 1630 may control the acoustic output apparatus to perform a function corresponding to the identified action and/or posture.

In some embodiments, the identified action and/or posture may include a count and/or frequency of blinking of the user, a count, direction, and/or frequency of nodding and/or shaking head of the user, and a count, direction, frequency, and form of hand movements of the user, etc. For example, the user may interact with the acoustic output apparatus by blinking a certain times and/or at a certain frequency. Specifically, the user may turn on the sound playback function of the acoustic output device by blinking twice, and turn off the Bluetooth function of the acoustic output device by blinking three times. As another example, the user may interact with the acoustic output apparatus by nodding a certain count, in a certain direction and/or at a certain frequency. Specifically, the user may answer a call by nodding once, and reject the call or turn off music playback by shaking his/her head once. As a further example, the user may interact with the acoustic output apparatus through a gesture, or the like. Specifically, the user may open the acoustic output apparatus by extending his/her palm, close the acoustic output apparatus by holding his/her fist, take a picture by making a "scissor" gesture, or the like. As still a further example, in an AR scenario, the user may interact with the acoustic output apparatus via a virtual UI. Specifically, the acoustic output apparatus may provide a plurality of choices corresponding to spatially delineated zones in an array defined relative to a physical position of the acoustic output apparatus. The user may shake his/her head to switch between different zones, or blink once to expand a zone.

The auxiliary control module 1640 may be configured to detect working states of the acoustic output apparatus and components thereof, and control the acoustic output apparatus and the components thereof according to the working states (e.g., a placement state, a worn state, whether it has been tapped, an angle of inclination, power, etc.). For example, when detecting that the acoustic output apparatus is not worn, the auxiliary control module 1640 may power off one or more components of the acoustic output apparatus after a preset time (e.g., 15 s). As another example, when detecting regular taps (e.g., two consecutive rapid taps) on the acoustic output apparatus, the auxiliary control module 1640 may pause the output of the acoustic output apparatus. As a further example, when detecting a state of low power of a power module included in the acoustic output apparatus, the auxiliary control module 1640 may control the acoustic output apparatus to output a prompt sound for charging.

In some embodiments, the auxiliary control module 1640 may include a detector, a sensor, a gyroscope, or the like. The detector may include a battery detector, a weight detector, an infrared detector, a mechanical detector, or the like, or any combination thereof. The sensor may include a temperature sensor, a humidity sensor, a pressure sensor, a displacement sensor, a flow sensor, a liquid level sensor, a force sensor, a speed sensor, a torque sensor, or the like, or any combination thereof. The gyroscope may be configured to detect a placement direction of the acoustic output apparatus. For example, when the gyroscope detects that a bottom of the acoustic output apparatus is placed upward, the auxiliary control module 1640 may turn off the power module after a preset time (e.g., 20 s). The gyroscope may also communicate with a gyroscope of an external device (e.g., a mobile phone) directly or through a communication module, such that the auxiliary control module 1640 may control the acoustic output apparatus based on detection results of the gyroscope included in the auxiliary control module 1640 and the gyroscope of the external device. For example, when the gyroscope included in the auxiliary control module 1640 detects that a bottom of the acoustic output apparatus is placed upward, and the gyroscope of the external device detects that the external device is in a static state, the auxiliary control module 1640 may turn off the power module after a preset time (e.g., 15 s).

The indication control module 1650 may be configured to indicate working states of the acoustic output apparatus. In some embodiments, the indication control module 1650 may include an indicator. The indicator may emit one or more colored lights and/or blink different times to indicate different states (e.g., on, off, volume, power, tone, speed of speech, etc.) of the acoustic output apparatus. For example, when the acoustic output apparatus is turned on, the indicator may emit green light, and when the acoustic output apparatus is turned off, the indicator may emit red light. As another example, when the acoustic output apparatus is turned on, the indicator may blink three times, and when the acoustic output apparatus is turned off, the indicator may blink one time. As a further example, when the acoustic output apparatus provides an AR/VR scenario, the indicator may emit green light, and when the acoustic output apparatus stops providing an AR/VR scenario, the indicator may emit red light. In some embodiments, the indicator may also emit light of one or more colors and/or blink different times to indicate a connection state of a communication module in the acoustic output apparatus. For example, when the communication module connects with an external device, the indicator may emit green light, and when the communication module fails to connect with the external device, the indicator may emit red light. As a further example, when the communication module fails to connect with the external device, the indicator may keep flashing. In some embodiments, the indicator may also emit light of one or more colors and/or blink different times to indicate the power of a power module. For example, when the power module is out of power, the indicator may emit red light. As another example, when the power module is out of power, the indicator may keep flashing. In some embodiments, the indicator may be disposed at any position of the acoustic output apparatus. For example, the indicator may be disposed on the leg 1410, the leg 1420, or the lens ring 1430 of the glasses 1400.

The modules in the interactive control component 1600 may be connected to or communicate with each other via a wired connection or a wireless connection. The wired connection may include a metal cable, an optical cable, a hybrid cable, or the like, or any combination thereof. The wireless connection may include a Local Area Network (LAN), a Wide Area Network (WAN), a Bluetooth, a ZigBee, a Near Field Communication (NFC), or the like, or any combination thereof. Two or more of the modules may be combined as a single module, and any one of the modules may be divided into two or more units. In some embodiments, the interactive control component 1600 may include one or more other modules and/or units, and one or more modules and/or units included in the interactive control component 1600 may be unnecessary. For example, the indication control module 1650 may also include a voice indication unit which may be configured to indicate working states of the acoustic output apparatus by using pre-stored voices. As another example, the auxiliary control module 1640 may be unnecessary. At least part of functions of the auxiliary control module 1640 may be implemented by other modules included in the interactive control component 1600.

Figure 18:
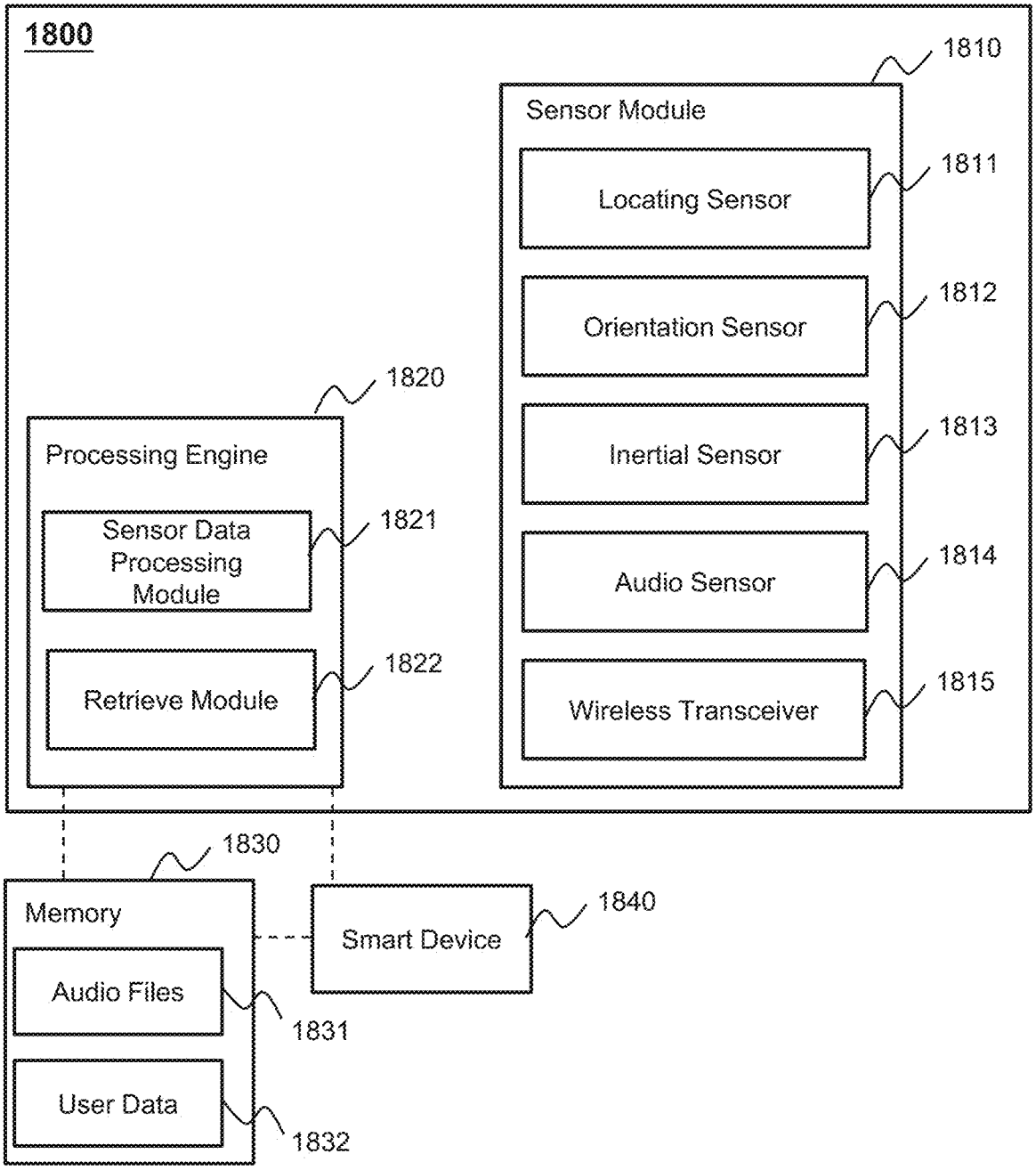
FIG. 18 is a schematic diagram illustrating an exemplary acoustic output apparatus customized for augmented reality according to some embodiments of the present disclosure.

FIG. 18 is a schematic diagram illustrating an exemplary acoustic output apparatus customized for augmented reality according to some embodiments of the present disclosure. Merely for illustration purposes, the acoustic output apparatus 1800 may be or include an AR glasses. The AR glasses may include a frame and lenses. The AR glasses may be provided with a plurality of components which may implement different functions. Details regarding structures and components of the AR glasses may be described with reference to the glasses 1400 illustrated in FIG. 14. In some embodiments, the acoustic output apparatus 1800 may include a sensor module 1810 and a processing engine 1820. In some embodiments, the power source assembly may also provide electrical power to the sensor module 1810 and/or the processing engine 1820.

The sensor module 1810 may include a plurality of sensors of various types. The plurality of sensors may detect status information of a user (e.g., a wearer) of the acoustic output apparatus. The status information may include, for example, a location of the user, a gesture of the user, a direction that the user faces, an acceleration of the user, a speech of the user, etc. A controller (e.g., the processing engine 1820) may process the detected status information, and cause one or more components of the acoustic output apparatus 1800 to implement various functions or methods described in the present disclosure. For example, the controller may cause at least one acoustic driver to output sound based on the detected status information. The sound output may be originated from audio data from an audio source (e.g., a terminal device of the user, a virtual audio marker associated with a geographic location, etc.). The plurality of sensors may include a locating sensor 1811, an orientation sensor 1812, an inertial sensor 1813, an audio sensor 1814, and a wireless transceiver 1815. Merely for illustration, only one sensor of each type is illustrated in FIG. 18. Multiple sensors of each type may also be contemplated. For example, two or more audio sensors may be used to detect sounds from different directions.

The locating sensor 1811 may determine a geographic location of the acoustic output apparatus 1800. The locating sensor 1811 may determine the location of the acoustic output apparatus 1800 based on one or more location-based detection systems such as a global positioning system (GPS), a W-Fi location system, an infra-red (IR) location system, a bluetooth beacon system, etc. The locating sensor 1811 may detect changes in the geographic location of the acoustic output apparatus 1800 and/or a user (e.g., the user may wear the acoustic output apparatus 1800, or may be separated from the acoustic output apparatus 1800) and generate sensor data indicating the changes in the geographic location of the acoustic output apparatus 1800 and/or the user.

The orientation sensor 1812 may track an orientation of the user and/or the acoustic output apparatus 1800. The orientation sensor 1812 may include a head-tracking device and/or a torso-tracking device for detecting a direction in which the user is facing, as well as the movement of the user and/or the acoustic output apparatus 1800. Exemplary head-tracking devices or torso-tracking devices may include an optical-based tracking device (e.g., an optical camera), an accelerometer, a magnetometer, a gyroscope, a radar, etc. In some embodiments, the orientation sensor 1812 may detect a change in the users orientation, such as a turning of the torso or an about-face movement, and generate sensor data indicating the change in the orientation of the body of the user.

The inertial sensor 1813 may sense gestures of the user or a body part (e.g., head, torso, limbs) of the user. The inertial sensor 1813 may include an accelerometer, a gyroscope, a magnetometer, or the like, or any combination thereof. In some embodiments, the accelerometer, the gyroscope, and/or the magnetometer may be independent components. In some embodiments, the accelerometer, the gyroscope, and/or the magnetometer may be integrated or collectively housed in a single sensor component. In some embodiments, the inertial sensor 1813 may detect an acceleration, a deceleration, a tilt level, a relative position in the three-dimensional (3D) space, etc. of the user or a body part (e.g., an arm, a finger, a leg, etc.) of the user, and generate sensor data regarding the gestures of the user accordingly.

The audio sensor 1814 may detect sound from the user, a smart device 1840, and/or ambient environment. In some embodiments, the audio sensor 1814 may include one or more microphones, or a microphone array. The one or more microphones or the microphone array may be housed within the acoustic output apparatus 1800 or in another device connected to the acoustic output apparatus 1800. In some embodiments, the one or more microphones or the microphone array may be generic microphones. In some embodiments, the one or more microphones or the microphone array may be customized for VR and/or AR.

In some embodiments, the audio sensor 1814 may be positioned so as to receive audio signals proximate to the acoustic output apparatus 1800, e.g., speech/voice input by the user to enable a voice control functionality. For example, the audio sensor 1814 may detect sounds of the user wearing the acoustic output apparatus 1800 and/or other users proximate to or interacting with the user. The audio sensor 1814 may further generate sensor data based on the received audio signals.

The wireless transceiver 1815 may communicate with other transceiver devices in distinct locations. The wireless transceiver 1815 may include a transmitter and a receiver. Exemplary wireless transceivers may include, for example, a Local Area Network (LAN) transceiver, a Wide Area Network (WAN) transceiver, a ZigBee transceiver, a Near Field Communication (NFC) transceiver, a bluetooth (BT) transceiver, a bluetooth Low Energy (BTLE) transceiver, or the like, or any combination thereof. In some embodiments, the wireless transceiver 1815 may be configured to detect an audio message (e.g., an audio cache or pin) proximate to the acoustic output apparatus 1800, e.g., in a local network at a geographic location or in a cloud storage system connected with the geographic location. For example, another user, a business establishment, a government entity, a tour group, etc. may leave an audio message at a particular geographic or virtual location, and the wireless transceiver 1815 may detect the audio message, and prompt the user to initiate a playback of the audio message.

In some embodiments, the sensor module 1810 (e.g., the locating sensor 1811, the orientation sensor 1812, and the inertial sensor 1813) may detect that the user moves toward or looks in a direction of a point of interest (POI). The POI may be an entity corresponding to a geographic or virtual location. The entity may include a building (e.g., a school, a skyscraper, a bus station, a subway station, etc.), a landscape (e.g., a park, a mountain, etc.), or the like. In some embodiments, the entity may be an object specified by a user. For example, the entity may be a favorite coffee shop of the user. In some embodiments, the POI may be associated with a virtual audio marker. One or more localized audio messages may be attached to the audio marker. The one or more localized audio message may include, for example, a song, a pre-recorded message, an audio signature, an advertisement, a notification, or the like, or any combination thereof.

The processing engine 1820 may include a sensor data processing module 1821 and a retrieve module 1822. The sensor data processing module 1821 may process sensor data obtained from the sensor module 1810 (e.g., the locating sensor 1811, the orientation sensor 1812, the inertial sensor 1813, the audio sensor 1814, and/or the wireless transceiver 1815), and generate processed information and/or data. The information and/or data generated by the sensor data processing module 1821 may include a signal, a representation, an instruction, or the like, or any combination thereof. For example, the sensor data processing module 1821 may receive sensor data indicating the location of the acoustic output apparatus 1800, and determine whether the user is proximate to a POI or whether the user is facing towards a POI. In response to a determination that the user is proximate to the POI or the user is facing towards the POI, the sensor data processing module 1821 may generate a signal and/or an instruction used for causing the retrieve module 1822 to obtain an audio message (i.e., a localized audio message associated with the POI). The audio message may be further provided to the user via the acoustic output apparatus 1800 for playback.

Optionally or additionally, during the playback of the audio message, an active noise reduction (ANR) technique may be performed so as to reduce noise. As used herein, the ANR may refer to a method for reducing undesirable sound by generating additional sound specifically designed to cancel the noise in the audio message according to the reversed phase cancellation principle. The additional sound may have a reversed phase, a same amplitude, and a same frequency as the noise. Merely by way of example, the acoustic output apparatus 1800 may include an ANR module (not shown) configured to reduce the noise. The ANR module may receive sensor data generated by the audio sensor 1814, signals generated by the processing engine 1820 based on the sensor data, or the audio messages received via the wireless transceiver 1815, etc. The received data, signals, audio messages, etc. may include sound from a plurality of directions, which may include desired sound received from a certain direction and undesired sound (i.e., noise) received from other directions. The ANR module may analyze the noise, and perform an ANR operation to suppress or eliminate the noise.

In some embodiments, the ANR module may provide a signal to a transducer disposed in the acoustic output apparatus to generate an anti-noise acoustic signal. The anti-noise acoustic signal may reduce or substantially prevent the noises from being heard by the user. In some embodiments, the anti-noise acoustic signal may be generated according to the noise detected by the acoustic output apparatus (e.g., the audio sensor 1814). For example, the anti-noise acoustic signal may have a same amplitude, a same frequency, and a reverse phase as the detected noise.

The processing engine 1820 may be coupled (e.g., via wireless and/or wired connections) to a memory 1830. The memory 1830 may be implemented by any storage device capable of storing data. In some embodiments, the memory 1830 may be located in a local server or a cloud-based server, etc. In some embodiments, the memory 1830 may include a plurality of audio files 1831 for playback by the acoustic output apparatus 1800 and/or user data 1832 of one or more users. The audio files 1831 may include audio messages (e.g., audio pins or caches created by the user or other users), audio information provided by automated agents, or other audio files available from network sources coupled with a network interface, such as a network-attached storage (NAS) device, a DLNA server, etc. The audio files 1831 may be accessible by the acoustic output apparatus 1800 over a local area network such as a wireless (e.g., Wi-Fi) or wired (e.g., Ethernet) network. For example, the audio files 1831 may include localized audio messages attached to virtual audio markers associated with a POI, which may be accessed when a user is proximate to or facing towards a POI.

The user data 1832 may be user-specific, community-specific, device-specific, location-specific, etc. In some embodiments, the user data 1832 may include audio information related to one or more users. Merely by ways of example, the user data 1832 may include user-defined playlists of digital music files, audio messages stored by the user or other users, information about frequently played audio files associated with the user or other similar users (e.g., those with common audio file listening histories, demographic traits, or Internet browsing histories), "liked" or otherwise favored audio files associated with the user or other users, a frequency at which the audio files 1831 are updated by the user or other users, or the like, or any combination thereof. In some embodiments, the user data 1832 may further include basic information of the one or more users. Exemplary basic information may include names, ages, careers, habits, preferences, etc.

The processing engine 1820 may also be coupled with a smart device 1840 that has access to user data (e.g., the user data 1832) or biometric information about the user. The smart device 1840 may include one or more personal computing devices (e.g., a desktop or laptop computer), wearable smart devices (e.g., a smart watch, a smart glasses), a smart phone, a remote control device, a smart beacon device (e.g., a smart bluetooth beacon system), a stationary speaker system, or the like, or any combination thereof. In some embodiments, the smart device 1840 may include a conventional user interface for permitting interaction with the user, one or more network interfaces for interacting with the processing engine 1820 and other components in the acoustic output apparatus 1800. In some embodiments, the smart device 1840 may be utilized to connect the acoustic output apparatus 1800 to a Wi-Fi network, creating a system account for the user, setting up music and/or location-based audio services, browsing content for playback, setting assignments of the acoustic output apparatus 1800 or other audio playback devices, transporting control (e.g., play/pause, fast forward/rewind, etc.) of the acoustic output apparatus 1800, selecting one or more acoustic output apparatus for content playback (e.g., a single room playback or a synchronized multi-room playback), etc. In some embodiments, the smart device 1840 may further include sensors for measuring biometric information about the user. Exemplary biometric information may include travel, sleep, or exercise patterns, body temperature, heart rates, paces of gait (e.g., via accelerometers), or the like, or any combination thereof.

The retrieve module 1822 may be configured to retrieve data from the memory 1830 and/or the smart device 1840 based on the information and/or data generated by the sensor data processing module 1821, and determine audio message for playback. For example, the sensor data processing module 1821 may analyze one or more voice commands from the user (obtained from the audio sensor 1814), and determine an instruction based on the one or more voice commands. The retrieve module 1822 may obtain and/or modify a localized audio message based on the instruction. As another example, the sensor data processing module 1821 may generate signals indicating that a user is proximate to a POI and/or the user is facing towards the POI. Accordingly, the retrieve module 1822 may obtain a localized audio message associated with the POI based on the signals. As a further example, the sensor data processing module 1821 may generate a representation indicating a characteristic of a location as a combination of factors from the sensor data, the user data 1832 and/or information from the smart device 1840. The retrieve module 1822 may obtain the audio message based on the representation.

Figure 19:
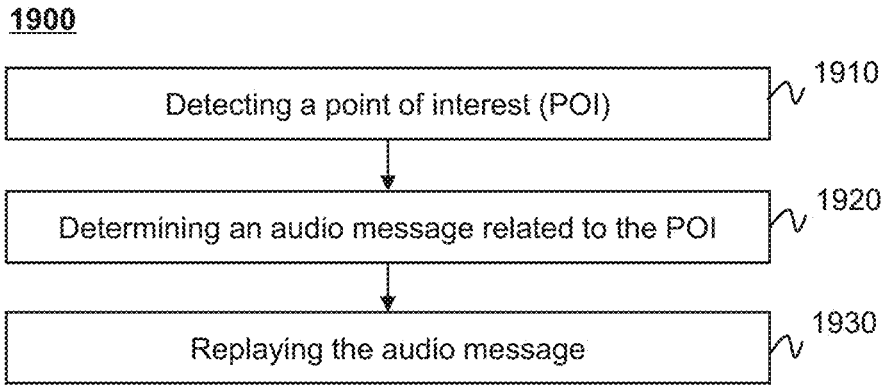
FIG. 19 is a flowchart illustrating an exemplary process for replaying an audio message according to some embodiments of the present disclosure.

FIG. 19 is a flowchart illustrating an exemplary process for replaying an audio message according to some embodiments of the present disclosure.

In 1910, a point of interest (POI) may be detected. In some embodiments, the POI may be detected by the sensor module 1810 of the acoustic output apparatus 1800.

As used herein, the POI may be an entity corresponding to a geographic or virtual location. The entity may include a building (e.g., a school, a skyscraper, a bus station, a subway station, etc.), a landscape (e.g., a park, a mountain, etc.), or the like, or any combination thereof. In some embodiments, the entity may be an object specified by the user. For example, the entity may be a favorite coffee shop of the user. In some embodiments, the POI may be associated with a virtual audio marker. One or more localized audio messages may be attached to the audio marker. The one or more localized audio message may include, for example, a song, a pre-recorded message, an audio signature, an advertisement, a notification, or the like, or any combination thereof.

In some embodiments, the sensor module 1810 (e.g., the locating sensor 1811, the orientation sensor 1812, and the inertial sensor 1813) may detect that a user wearing the acoustic output apparatus 1800 moves toward to or looks in the direction of the POI. Specifically, the sensor module 1810 (e.g., the locating sensor 1811) may detect changes in a geographic location of the user, and generate sensor data indicating the changes in the geographic location of the user. The sensor module 1810 (e.g., the orientation sensor 1812) may detect changes in an orientation of the user (e.g., the head of the user), and generate sensor data indicating the changes in the orientation of the user. The sensor module 1810 (e.g., the inertial sensor 1813) may also detect gestures (e.g., via an acceleration, a deceleration, a tilt level, a relative position in the three-dimensional (3D) space, etc. of the user or a body part (e.g., an arm, a finger, a leg, etc.)) of the user, and generate sensor data indicating the gestures of the user. The sensor data may be transmitted, for example, to the processing engine 1820 for further processing. For example, the processing engine 1820 (e.g., the sensor data processing module 1821) may process the sensor data, and determine whether the user moves toward to or looks in the direction of the POI.

In some embodiments, other information may also be detected. For example, the sensor module 1810 (e.g., the audio sensor 1814) may detect sound from the user, a smart device (e.g., the smart device 1840), and/or ambient environment. Specifically, one or more microphones or a microphone array may be housed within the acoustic output apparatus 1800 or in another device connected to the acoustic output apparatus 1800. The sensor module 1810 may detect sound using the one or more microphones or the microphone array. In some embodiments, the sensor module 1810 (e.g., the wireless transceiver 1815) may communicate with transceiver devices in distinct locations, and detect an audio message (e.g., an audio cache or pin) when the acoustic output apparatus 1800 is proximate to the transceiver devices. In some embodiments, other information may also be transmitted as part of the sensor data to the processing engine 1820 for processing.

In 1920, an audio message related to the POI may be determined. In some embodiments, the audio message related to the POI may be determined by the processing engine 1820.

In some embodiments, the processing engine 1820 (e.g., the sensor data processing module 1821) may generate information and/or data based at least in part on the sensor data. The information and/or data include a signal, a representation, an instruction, or the like, or any combination thereof. Merely by way of example, the sensor data processing module 1821 may receive sensor data indicating a location of a user, and determine whether the user is proximate to or facing towards the POI. In response to a determination that the user is proximate to the POI or facing towards the POI, the sensor data processing module 1821 may generate a signal and/or an instruction causing the retrieve module 1822 to obtain an audio message (i.e., a localized audio message attached to an audio marker associated with the POI). As another example, the sensor data processing module 1821 may analyze sensor data related to a voice command detected from a user (e.g., by performing a natural language processing), and generate a signal and/or an instruction related to the voice command. As a further example, the sensor data processing module 1821 may generate a representation by weighting the sensor data, user data (e.g., the user data 1832), and other available data (e.g., a demographic profile of a plurality of users with at least one common attribute with the user, a categorical popularity of an audio file, etc.). The representation may indicate a general characteristic of a location as a combination of factors from the sensor data, the user data and/or information from a smart device.

Further, the processing engine 1820 (e.g., the retrieve module 1822) may determine an audio message related to the POI based on the generated information and/or the data. For example, the processing engine 1820 may retrieve an audio message from the audio files 1831 in the memory 1830 based on a signal and/or an instruction related to a voice command. As another example, the processing engine 1820 may retrieve an audio message based on a representation and relationships between the representation and the audio files 1831. The relationships may be predetermined and stored in a storage device. As a further example, the processing engine 1820 may retrieve a localized audio message related to a POI when a user is proximate to or facing towards the POI. In some embodiments, the processing engine 1820 may determine two or more audio messages related to the POI based on the information and/or the data. For example, when a user is proximate to or facing towards the POI, the processing engine 1820 may determine audio messages including "liked" music files, audio files accessed by other users at the POI, or the like, or any combination thereof.

Taking an acoustic output apparatus customized for VR as an example, the acoustic output apparatus may determine an audio message related to a POI based at least in part on sensor data obtained by sensors disposed in the acoustic output apparatus. For example, the POI may be a historical site associated with a virtual audio marker having one or more localized audio messages. When the user wearing the acoustic output apparatus is proximate to or facing towards the historical site, the localized audio messages may be recommended to the user via a virtual interface. The one or more localized audio messages may include virtual environment data used to relive historical stories of the historical site. In the virtual environment data, sound data may be properly designed for simulating sound effects of different scenarios. For example, sound may be transmitted from different sound guiding holes to simulate sound effects of different directions. As another example, the volume and/or delay of sound may be adjusted to simulate sound effects at different distances.

Figure 20:
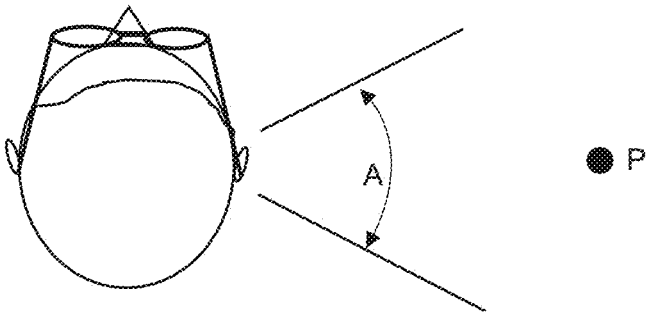
FIG. 20 is a schematic diagram illustrating an exemplary acoustic output apparatus focusing on sounds in a certain direction according to some embodiments of the present disclosure.

Taking an acoustic output apparatus customized for AR as another example, the acoustic output apparatus may determine an audio message related to a POI based at least in part on sensor data obtained by sensors disposed in the acoustic output apparatus. Additionally, the audio message may be combined with real-world sound in ambient environment so as to enhance an audio experience of the user. The real-world sound in ambient environment may include sounds in all directions of the ambient environment, or may be sounds in a certain direction. Merely by way of example, FIG. 20 is a schematic diagram illustrating an exemplary acoustic output apparatus focusing on sounds in a certain direction according to some embodiments of the present disclosure. As illustrated in FIG. 20, when a user is proximate to a POI P, an acoustic output apparatus (e.g., the acoustic output apparatus 1800) worn by the user may focus on sound received from a virtual audio cone. The vertex of the virtual audio cone may be the acoustic output apparatus. The virtual audio cone may have any suitable size, which may be determined by an angle of the virtual audio cone. For example, the acoustic output apparatus may focus on sound of a virtual audio cone with an angle of, for example, 20°, 40°, 60°, 80°, 120°, 180°, 270°, 360°, etc. In some embodiments, to focus on sound within the range of the virtual audio cone, the acoustic output apparatus may improve audibility of most or all sound in the virtual audio cone. For example, an ANR technique may be used by the acoustic output apparatus so as to reduce or substantially prevent sound in other directions (e.g., sounds outside of the virtual audio cones) from being heard by the user. Additionally, the POI may be associated with virtual audio markers to which localized audio messages may be attached. The localized audio messages may be accessed when the user is proximate to or facing towards the POI. That is, the localized audio messages may be overlaid on the sound in the virtual audio cone so as to enhance an audio experience of the user. In some embodiments, a direction and/or a virtual audio cone of the sound focused by the acoustic output apparatus may be determined according to actual needs. For example, the acoustic output apparatus may focus on sound in a plurality of virtual audio cones in different directions simultaneously. As another example, the acoustic output apparatus may focus on sound in a specified direction (e.g., the north direction). As a further example, the acoustic output apparatus may focus on sound in a walking direction and/or a facing direction of the user.

In 1930, the audio message may be replayed. In some embodiments, the audio message may be replayed by the processing engine 1820.

In some embodiments, the processing engine 1820 may replay the audio message via the acoustic output apparatus 1800 directly. In some embodiments, the processing engine 1820 may prompt the user to initiate a playback of the audio message. For example, the processing engine 1820 may output a prompt (e.g., a voice prompt via a sound guiding hole, a visual representation via a virtual user-interface) to the user. The user may respond to the prompt by interacting with the acoustic output apparatus 1800. For example, the user may interact with the acoustic output apparatus 1800 using, for example, gestures of his/her body (e.g., head, torso, limbs, eyeballs), voice command, etc.

Figure 21:
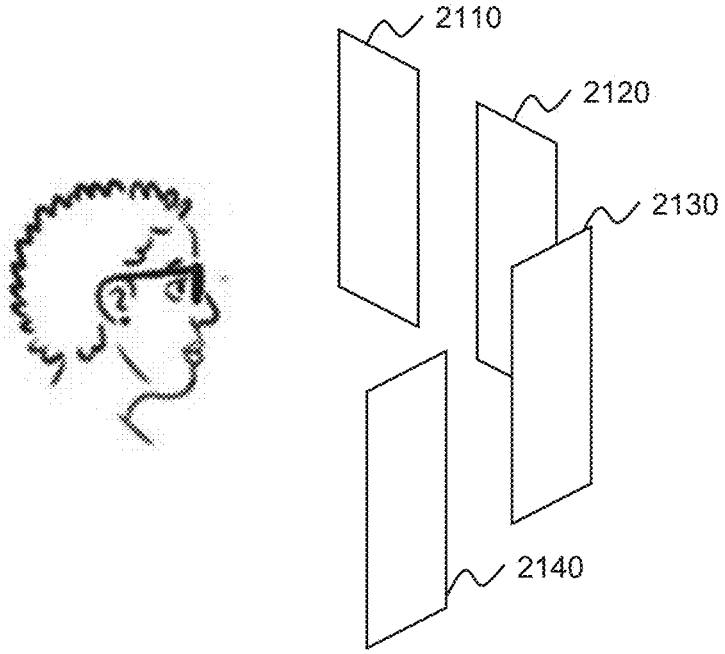
FIG. 21 is a schematic diagram illustrating an exemplary user interface of an acoustic output apparatus according to some embodiments of the present disclosure.

Taking an acoustic output apparatus customized for AR as another example, the user may interact with the acoustic output apparatus via a virtual user-interface (UI). FIG. 21 is a schematic diagram illustrating an exemplary UI of the acoustic output apparatus. As illustrated in FIG. 21, the virtual UI may be present in a head position and/or a gaze direction of the user. In some embodiments, the acoustic output apparatus may provide a plurality of audio samples, information, or choices corresponding to spatially delineated zones (e.g., 2110, 2120, 2130, 2140) in an array defined relative to a physical position of the acoustic output apparatus. Each audio sample or piece of information provided to the user may correspond to an audio message to be replayed. In some embodiments, the audio samples may include a selection of an audio file or stream, such as a representative segment of the audio content (e.g., an introduction to an audio book, a highlight from a sporting broadcast, a description of the audio file or stream, a description of an audio pin, an indicator of the presence of an audio pin, an audio beacon, a source of an audio message). In some embodiments, the audio samples may include entire audio content (e.g., an entire audio file). In some embodiments, the audio samples, information, or choices may be used as prompts for the user. The user may respond to the prompts by interacting with the acoustic output apparatus. For example, the user may click on a zone (e.g., 2120) to initiate a playback of entire audio content corresponding to the audio sample presented in the zone. As another example, the user may shake his/her head to switch between different zones.

The embodiments described above are merely implements of the present disclosure, and the descriptions may be specific and detailed, but these descriptions may not limit the present disclosure. It should be noted that those skilled in the art, without deviating from concepts of the bone conduction speaker, may make various modifications and changes to, for example, the sound transfer approaches described in the specification, but these combinations and modifications are still within the scope of the present disclosure.

What is claimed is:

1. An acoustic output apparatus, comprising:

a vibration device having a vibration conductive plate and a vibration board, wherein the vibration conductive plate is physically connected with the vibration board, vibrations generated by the vibration conductive plate and the vibration board have at least two resonance peaks, frequencies of the at least two resonance peaks being catchable with human ears, and sounds are generated by the vibrations transferred through a human bone; and an interactive control component configured to allow an interaction between a user and the acoustic output apparatus.

2. The acoustic output apparatus of claim 1, wherein the interactive control component comprises at least one of:

a button control module, configured to control the acoustic output apparatus based on an instruction input by the user through buttons;

a voice control module, configured to control the acoustic output apparatus based on a voice control instruction received from the user;

a posture control module, configured to control the acoustic output apparatus based on a posture of the user;

an auxiliary control module, configured to control the acoustic output apparatus based on a working state of the acoustic output apparatus; and an indication control module, configured to indicate a working state of the acoustic output apparatus.

3. The acoustic output apparatus of claim 2, wherein the voice control module comprises:

a receiving unit, configured to receive the voice control instruction from the user;

a processing unit, configured to generate an instruction signal based on the voice control instruction;

a recognition unit, configured to identify whether the instruction signal matches a preset signal; and a control unit, configured to control the acoustic output apparatus based on the instruction signal and a matching result.

4. The acoustic output apparatus of claim 1, further comprising one or more sensors configured to detect status information of the user, wherein the one or more sensors include at least one of a locating sensor, an orientation sensor, an inertial sensor, an audio sensor, and a wireless transceiver.

5. The acoustic output apparatus of claim 4, wherein the one or more sensors detect a point of interest (POI) that the user is proximate to or facing towards.

6. The acoustic output apparatus of claim 1, further comprising a controller configured to cause the vibration device to output sound based on the detected status information of the user.

7. The acoustic output apparatus of claim 6, wherein to cause the vibration device to output sound based on the detected status information of the user, the controller is further configured to determine an audio message related to the POI; and cause the earphone core to replay the audio message upon the detection of the POI by the one or more sensors.

8. The acoustic output apparatus of claim 7, wherein the POI is a virtual audio marker with which the audio message is associated.

9. The acoustic output apparatus of claim 1, wherein the vibration device outputs sound through one or more sound guiding holes set on the acoustic output apparatus.

10. The acoustic output apparatus of claim 1, further comprising an active noise reduction module configured to generate an anti-noise acoustic signal to reduce noise.

11. The acoustic output apparatus of claim 1, wherein the vibration conductive plate includes a first torus and at least two first rods, the at least two first rods converging to a center of the first torus.

12. The acoustic output apparatus of claim 11, wherein the vibration board includes a second torus and at least two second rods, the at least two second rods converging to a center of the second torus.

13. The acoustic output apparatus of claim 12, wherein the first torus is fixed on a magnetic component.

14. The acoustic output apparatus of claim 13, further comprising a voice coil, wherein the voice coil is driven by the magnetic component and fixed on the second torus.

15. The acoustic output apparatus of claim 14, wherein the at least two first rods are staggered with the at least two second rods.

16. The acoustic output apparatus of claim 15, wherein a staggered angle between one of the at least two first rods and one of the at least two second rods is 60 degrees.

17. The acoustic output apparatus of claim 14, wherein the magnetic component comprises:

a bottom plate;

an annular magnet attaching to the bottom plate;

an inner magnet concentrically disposed inside the annular magnet;

an inner magnetic conductive plate attaching to the inner magnet;

an annular magnetic conductive plate attaching to the annular magnet; and a grommet attaching to the annular magnetic conductive plate.

18. The acoustic output apparatus of claim 1, wherein the vibration conductive plate is made of stainless steels and has a thickness in a range of 0.1 to 0.2 mm.

19. The acoustic output apparatus of claim 1, wherein a lower resonance peak of the at least two resonance peaks is equal to or lower than 900 Hz.

20. The acoustic output apparatus of claim 19, wherein a higher resonance peak of the at least two resonance peaks is equal to or lower than 9500 Hz.

* * * * *